US010398185B2

(12) United States Patent
Ott

(10) Patent No.: US 10,398,185 B2
(45) Date of Patent: Sep. 3, 2019

(54) HAIR RESTORATION SYSTEM AND METHOD

(71) Applicant: Henryk Ott, Fair Oaks, CA (US)

(72) Inventor: Henryk Ott, Fair Oaks, CA (US)

( * ) Notice: Subject to any disclaimer, the term of this patent is extended or adjusted under 35 U.S.C. 154(b) by 525 days.

(21) Appl. No.: 15/264,517

(22) Filed: Sep. 13, 2016

(65) Prior Publication Data

US 2018/0070665 A1 Mar. 15, 2018

Related U.S. Application Data

(62) Division of application No. 14/466,959, filed on Aug. 23, 2014, now Pat. No. 9,439,465.

(51) Int. Cl.
*A41G 5/00* (2006.01)

(52) U.S. Cl.
CPC ..... *A41G 5/0086* (2013.01); *A41G 5/00* (2013.01); *A41G 5/008* (2013.01)

(58) Field of Classification Search
CPC ..... A41G 5/0086; A41G 5/008; A41G 5/00; A41G 5/0013; A41G 5/0053; A01K 13/00; A01K 13/003; A01K 13/005; A61H 3/44; A45D 2024/345; A45D 2007/002; A45D 2019/0041
USPC ..... 132/212, 53, 333
See application file for complete search history.

(56) References Cited

U.S. PATENT DOCUMENTS

2007/0272263 A1* 11/2007 Gold ..... A41G 5/0086 132/201
2011/0094527 A1* 4/2011 Gold ..... A41G 5/0086 132/53
2011/0146698 A1* 6/2011 Guliker ..... A41G 5/008 132/201

* cited by examiner

*Primary Examiner* — Tatiana L Nobrega
(74) *Attorney, Agent, or Firm* — Long & Chybik; John D. Long, Esq

(57) ABSTRACT

The invention could comprise a hair augmentation system comprising a binding comb comprising a handle supporting both a prong section and a clamp, the clamp is capable of removably securing to the binding comb one or more hair strands held by the prong section; an adhesive tray for applying extension adhesive to an adhesive applicator; the adhesive applicator moving in the adhesive tray to transfer extension adhesive to the one or more hair extensions held by an extension applicator; and the extension applicator that removably mates to the binding comb so that the one or more of hair extensions with extension adhesive simultaneously binds with one or more of hair stands as held by the binding comb.

19 Claims, 39 Drawing Sheets

HAIR RESTORATION SYSTEM AND METHOD

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to hair restoration systems. More specifically, the present invention may related to hair restoration systems that provide hair restoration by generally bonding one or more hair extensions to individual hair strand in a hair strand group application.

BACKGROUND

Restoration of hair that has been thinned or lost due to disease, baldness, drug treatment and other causes may be restored through a variety of pharmaceutical, surgical, hair augmentation and other means. Pharmaceutical means may use a drug treatment approach to increase hair growth by reducing factors that interfere with such growth. For example, men with Male Pattern Baldness (i.e., androgenic alopecia) may be given drugs that reduce or interfere with the production of the enzyme that makes androgen dihydrotestosterone (DHT), which is known for causing Male Pattern Baldness.

The surgical means generally takes hair follicle transplants or hair-bearing skin grafts from a donor portion of the patient's scalp and places them into the recipient or hair loss scalp areas. This treatment, while generally considered the most expensive and invasive of the hair loss treatments, is considered the most permanent and is generally used for significant hair loss and/or physical reconstruction (e.g., for burn victims.)

Hair augmentation could be seen as a temporary and mechanical enhancement of existing hair to increase the cosmetic appearance (volume, length, thickness, and the like) of the person's head of hair (or other hair areas, such as eyebrows, etc.) by fastening extensions (e.g., extra human hair or artificial hair-like materials) to individual strands of the person's hair. Hair augmentation by extensions can be achieved through a variety of attachment means such as weave, adhesive and other means. When adhesive-bounded extension hair augmentation methods are employed, the extensions are glued to individual strands of the person's natural growing hair. The type of adhesive and the resulting quality of attachment used may be critical in these situations. If adhesive is non-uniformly applied to individual strands of hair, the resulting cosmetic effect is less than pleasing, leaving a noticeable non-uniform and unnatural effect. Further, depending on the adhesive use and bonding method, as the adhesive degrades it could allow for the separation of augmenting hair or projections from the host hair that also lead to a noticeable non-uniform and unnatural effect.

Of the adhesive-binding extension methods, the hot or cold fusion technique appears to have the most natural and realistic result. The fusion techniques use a protein-based (i.e., keratin, the same protein of which hair strands are made so as to generally avoid damaging the hair during the gluing process) polymer resin adhesive to attach extensions to the individual hair strands. The hot fusion techniques uses a resin adhesive that is fixed by a heat source (e.g., a curling iron.) In that the heat source cannot be applied to the base of the hair near the scalp (e.g., burning the scalp in the process) limits the hot fusion attachment of the extensions to the middle to tip of the individual hair strands. The cold fusion technique uses a resin adhesive that is activated by high frequency sonic or sound pulses (operating at frequencies substantially undetectable to the human ear) and the like. This allows the cold fusion technique to connect the extensions to the base of the individual hair strand for a superior feel and effect to the enhanced hair. Other activation types of polymer resin adhesives may be also used for extension attachment.

The fusion technique in generally can be seen as being a very labor intensive, manual operation application method (and hence time consuming and expensive) wherein the cosmologist or hair treatment professional isolates subject's hair into sections. Within the respective hair section, the cosmologist (generally assisted by the use of magnifying optics) then isolates a single or individual strand of hair one at a time. Once so isolated, the hair treatment professional then generally applies with a very small brush the desired fusion binding adhesive to the single hair strand. The hair treatment professional may then takes an extension, again one at a time, and affixes it to the glued portion of the hair strand. In this manner, multiple hair extensions may be attached to and augment the individual hair strand. This process is then repeated for other strands of hair with the section. Once the extensions are suitably affixed to the hair in section, the process is repeated for other desired all the described hair sections. When the hair extension attachment is completed for all the hair sections, the hair treatment professional may then use an appropriate method of finalizing the bonding of applied adhesive (e.g., heat, ultrasonic source, etc.) to finalize the bonding (e.g., "fuse") of the attached hair extensions to their respective individual hair strands to substantially complete the hair augmentation. Depending on the subject and desired result, the fusion hair augmentation process can take up to several hours to complete in order to provide a cosmologically pleasing result. The overall process to both the professional and subject may be tedious, time-consuming and costly.

What could be needed is a hair augmentation system and method that can consistently and uniformly applies and bonds hair extensions to respective individual hair strands, several hair strands at a time and still provide a long lasting, uniform, realistic and natural looking filled-out hair. Such a hair augmentation system could comprise a binding comb, an adhesive applicator and its adhesive tray and an extension applicator. The extension applicator could have an extension assembly connected by an ejection assembly that is attached to a handle. The extension assembly could have a set of spaced-apart vertical extension grooves, each extension groove receiving a tip of a hair extension from a tube bank removably attached to the top of the extension assembly. Each tube of a tube bank containing a hair extension. The extension tip could then be threaded into each respective extension groove's top lever and bottom lever that movably attached to a top and bottom of respective extension groove. Each lever can be manually rotated/lifted away to allow the tip to go between the lever and the extension groove. When released, the levers could help removably retain to the hair extension tip to the extension groove. A trigger assembly supported by the handle could move within the ejection assembly a pin plate holding set of operative pins. The operative pins so moved through the extension assembly could open the levers releasing the extension tips and further pushing the respective extension tip (e.g., as bounded to an individual hair strand) out of the extension groove.)

The adhesive tray could apply an extension adhesive to a set of spaced-apart adhesive tips as supported by the adhesive applicator with set of extension grooves. The adhesive tray could then further support the extension applicator so that when the adhesive applicator is generally moved in the tray, an individual extension adhesive laden tip will enter a respective extension groove to apply glue to the extension tip held within the extension groove.

The binding comb could be applied to a section of a subject's hair to removably clamp down upon and hold in set of single hair strands in a manner (e.g., a single hair strand held between a pair of comb prongs) that holds the respective individual hair strands in the spaced-apart positions from one another that matches the orientation of the adhesive applied extension tips in the extension assembly's set of extension grooves. The extension applicator is then brought into removable connection to the binding comb so that a respective adhesive applied extension tip comes into contact with respective hair strand held by the binding comb. The activation of the trigger assembly then opens the levers and may further to push out the hair strand/extension bound combinations together and out of their respective extension grooves. As the extension applicator the binding comb are then generally separated from one another, the individual hair strand pulls its attached extension free from the extension assembly. The binding comb may also releases its hair strand/extension combinations to be generally removed from the scalp/hair section.

The system may be reloaded with a new extension-loaded tube bank to substantially allow for the repeated attachment of extensions to additional hair strands. When subject's hair is generally augmented by hair extensions as desired, suitable steps as generally known by those skilled in the art may be undertaken to generally cause the final fusion bonding of the extensions to their respective hair strands. In a manner, the hair augmentation system and method may be seen as being faster, less expensive, less tedious but of the same high quality of the older hand-applied extension attachment process.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to have a jam-free hair extension applicator tool;

provide a hand-operated extension applicator with an binding comb that will advantageously decrease the process time and cost for restoring and extending a person's hair as well as increase the precision by which extensions are applied to respective individual hair strands;

the ability to removably mate a binding comb holding a set of hair strands with an extension applicator holding a set of hair extensions to allow a one-to-one matchup between hair extensions and respective individual hair strands;

provide an tray-mounted adhesive applicator that precisely applies adhesive only the desired portions of the adhesive applicator;

provide an tray-mounted adhesive applicator that precisely applies adhesive only the desired portions of the hair extensions;

the ability to slide an adhesive applicator back-and-forth on a tray containing adhesive that in one direction applies adhesive to adhesive applicator and that in another direction applies adhesive to hair extensions held by the extension applicator;

to provide a binding comb that can be easily modified to handle a wide variety of hair types and thicknesses;

the ability of a hair augmentation system that initially holds and bonds a set of extensions simultaneously to a wide variety of hair types having a wide variety of thicknesses;

to provide a hair augmentation system that bonds hair extensions to single hair strands doing multiple hair strands at a time, the attachment or fusion of hair extensions being done at the base of the single strand of hair being augmented;

the ability to use a series of extension tube banks, each tube of the bank being preloaded with a core extension to which have been bonded several other extensions, the preloaded extension tube banks removably attach to the extension applicator to allow easy and quick reloading of the extension applicator with hair extensions increasing the speed at which the present invention can be applied;

to provide an adhesive applicator that can quickly, easily and simultaneously apply adhesive to individual extension tips held within the extension applicator head;

the ability to removably hold a line of hair strands in a spaced-apart fashion with a binding comb that directly combines with an extension applicator to bond the hair strands individually together with their respective extensions;

the ability to significantly reduce hair extension application time; the hair damage and hair stress that may occur in other hair augmentation system operations;

provide a binding comb that can grasp curly hair strands to momentarily stretch them straight for easier bonding with hair extensions; and provide a hair augmentation system that is simple, rugged and inexpensive to operate and that individually applies hair extensions to several individual hair stands at once.

These and other advantages may be realized by reference to the remaining portions of the specification, claims, and abstract.

Brief Description of One Embodiment of the Present Invention

One possible embodiment of the invention could be a hair augmentation system comprising: a binding comb comprising a handle supporting both a first prong section and a clamp, the clamp is capable of removably securing to the binding comb one or more hair strands of a scalp placed within the first prong section; an adhesive tray having a cutout in which an adhesive applicator can move and in which the adhesive applicator is removably held; the adhesive applicator that moves relative to the adhesive tray to transfer extension adhesive from the adhesive tray to one or more hair extensions as held by an extension applicator; the extension applicator having a set of extension grooves with each extension groove having two levers, one lever that movably attaches proximate to a top of the extension groove and a second lever that movably attaches to a bottom of the extension groove, a trigger assembly acts upon a set of operative pins to cause the levers to release the one or more hair extensions from extension applicator; wherein the extension applicator that removably mates to a binding comb so that the one or more of hair extensions with extension adhesive as held by the extension application simultaneously binds with one or more of hair stands as held by the binding comb, the activation of the trigger assembly releases the bounded hair extension/hair stand combinations from the extension application.

Another possible embodiment of the invention could be a hair extension applicator comprising an extension assembly comprising an extension body that movably supports a plurality of levers, the extension body further defining a groove side and another side that are continuously connected by a plurality of open-ended pin channels, the groove side further defines a set of extension grooves; a tube bank comprising a set of open-ended tubes that attaches to the extension assembly, each open-ended tube capable of supporting a hair extension that is to be presented to set of extension grooves; an ejection assembly that attaches to the extension assembly, the ejection assembly comprising an ejection body and a plurality of operative pins that traverse at least a portion of the ejection body to be received within the plurality of open-ended pin channels; a handle supporting a trigger assembly, the trigger assembly upon activation causes the plurality of operative pins to move the plurality of levers to release any hair extensions that are placed between one or more levers of the plurality of levers and the extension body.

Yet another possible embodiment of the invention could be a process for the operation of a hair augmentation system comprising the following steps, but not necessarily in the order shown providing a binding comb having a handle supporting a prong section and a comb clamp; loading each of interstitial comb spaces as defined by the prong section with just a single individual hair strand from a hairline of a customer, then lowering the comb clamp upon the said hair strands to removably hold the said hair strands to the binding comb; providing an extension applicator with a set of side-by-side extension grooves, each extension groove further being associated with a respective pair of levers that removably holds a respective hair extension within the extension groove; upon activation of a trigger assembly the levers release the hair extensions from the respective extension grooves; providing an adhesive applicator that moves within a cutout of an adhesive tray, one tray end of the adhesive supporting an extension adhesive within the cutout while another tray end supports a portion of the extension applicator within the cutout; moving the adhesive applicator relative to the adhesive tray so to transfer the extension adhesive from the one tray end to hair extensions held by the extension applicator as the extension applicator is supported by the other tray end; removably attaching the adhesive applicator to the binding comb so that the glue-applied hair extensions as held by the extension applicator simultaneously binds with said hair stands individually held apart by the binding comb; activating the trigger assembly as the extension applicator is separated from the binding comb; and moving the comb paddle to releasing the hair stands as the binding comb moves away from the hairline of a customer.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
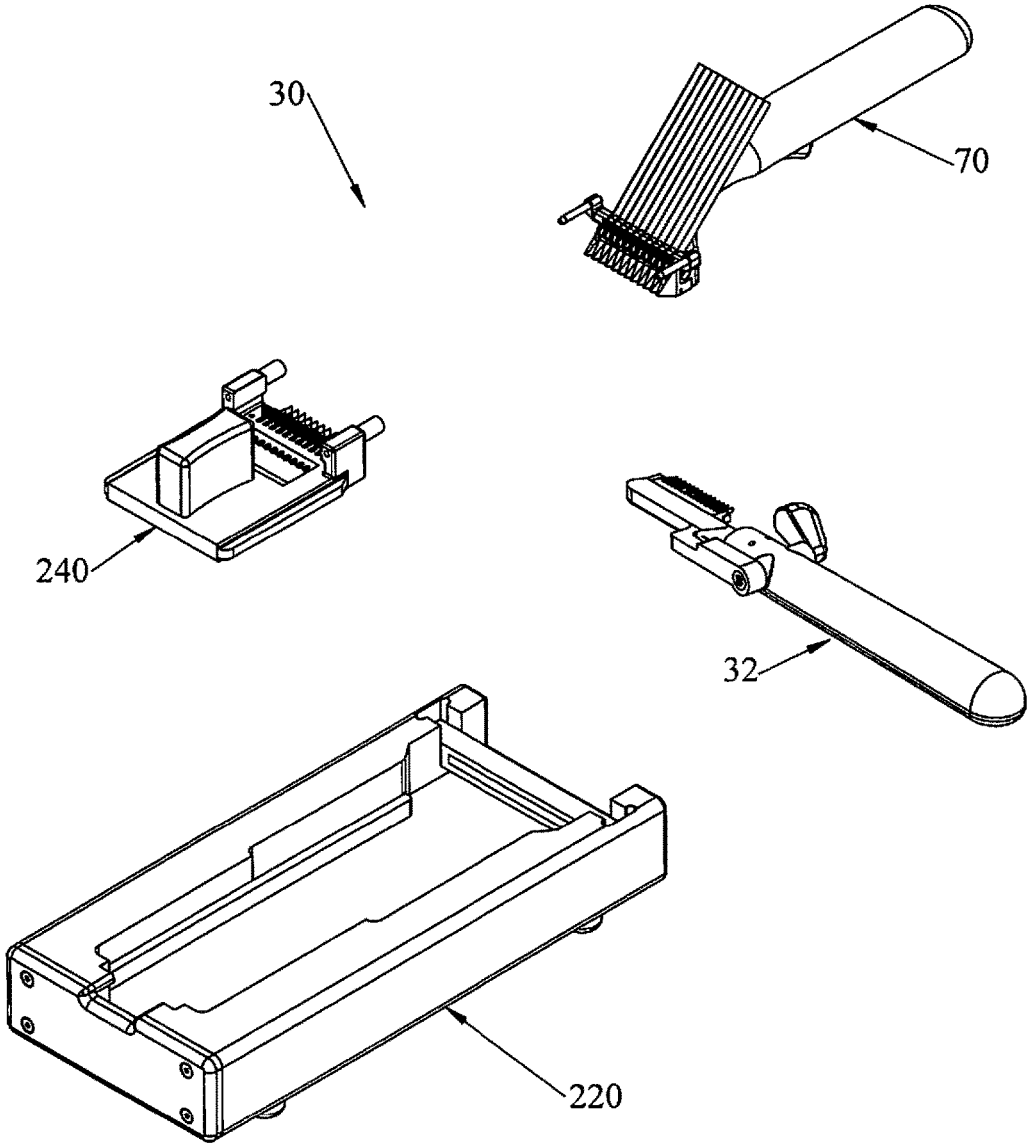
FIG. 1 is substantially a perspective view of one embodiment of the hair augmentation system showing the extension applicator, the binding comb, the adhesive applicator, and adhesive tray of the present invention.
Figure 2:
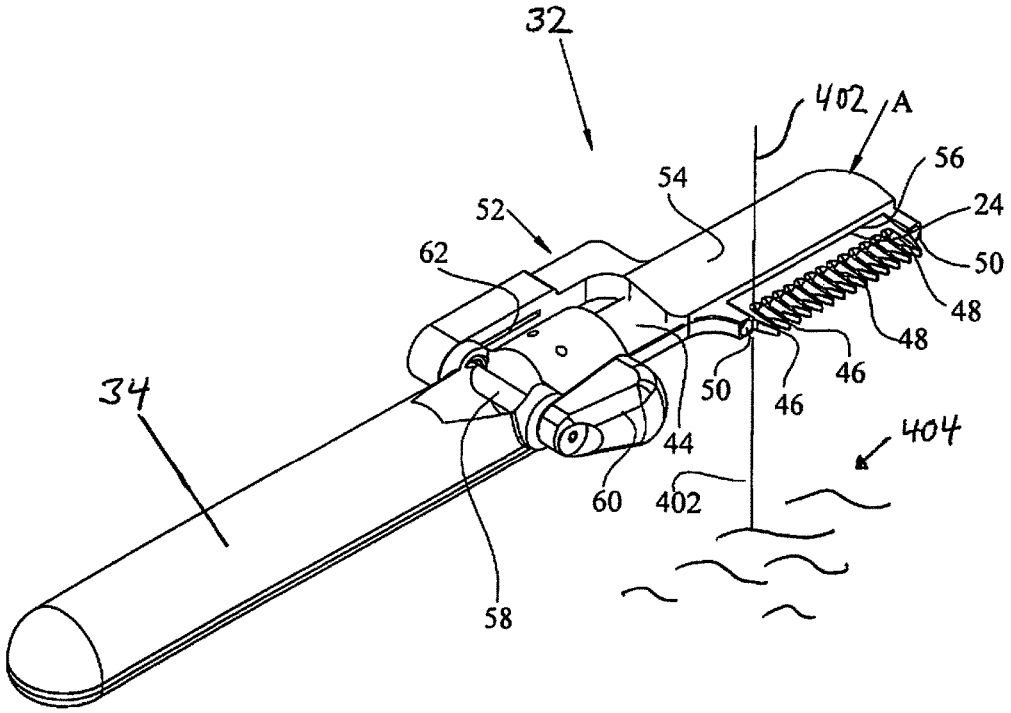
FIG. 2 is substantially a perspective cutaway view of a first embodiment of the binding comb of the present invention in the closed position.
Figure 2A:
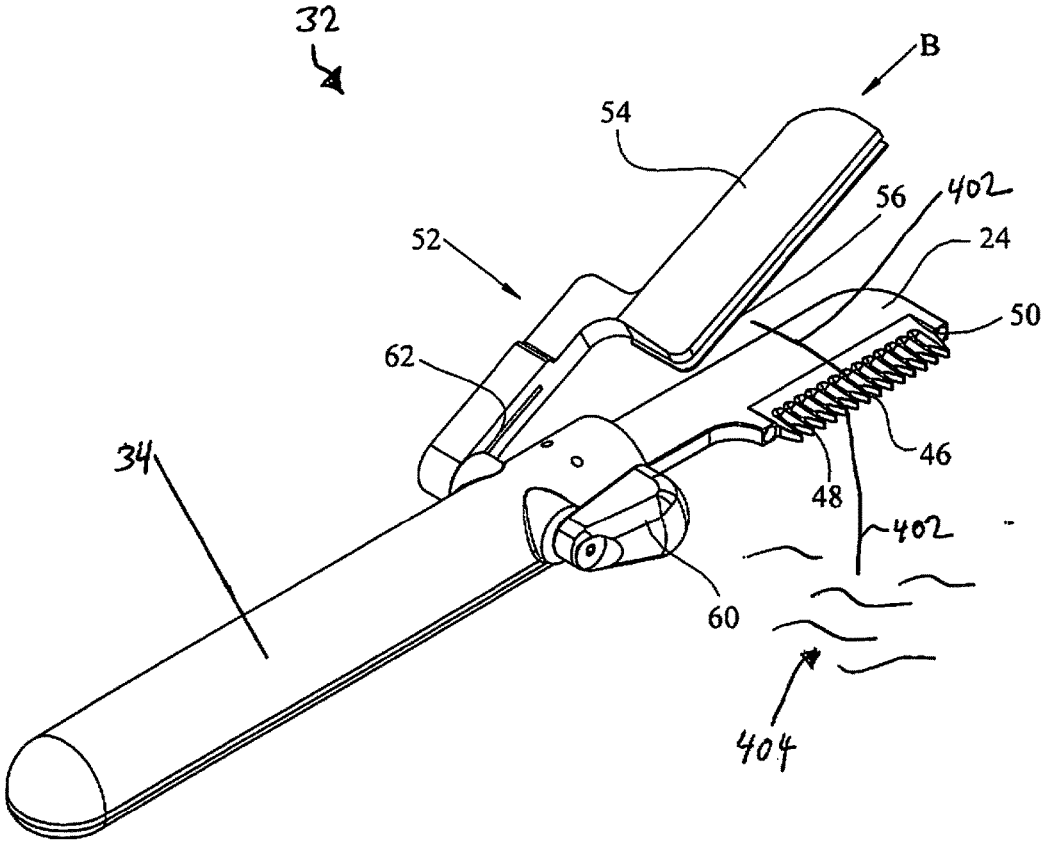
FIG. 2A is substantially a perspective view of a first embodiment of the binding comb of the present invention in the open position.

The present invention 10 could comprise a hair augmentation system 30 and process or method 200 for its operation that can consistently and uniformly adhesively bond or bind hair extensions to respective individual hair strands, the hair augmentation system 30 simultaneously binding of hair extensions to a group of individual hair strands on a one-to-one basis (e.g., one extension to one individual hair strand.) As generally shown in FIG. 1, such a hair augmentation system 30 could comprise a binding comb 32, an extension applicator 70; and a combination of adhesive applicator 240 and an adhesive tray 220. As substantially shown in FIGS. 2, 2A the binding comb 32 in one embodiment could have a comb handle 34 in line with and generally supporting a removably-attached prong section 44 generally denoting a set of spaced-apart prongs (e.g., tines or fingers) 46 that may mounted along a side edge of the prong section 24. The interstitial comb space 48 between a pair of prongs 26 could be used to accommodate an individual hair strand 402 from the scalp 404. The prong section 24 could be removably connected to the comb handle 34 in a manner that allows interchangeability of multiple prong sections 24, each respective prong section 24 being generally designed to accommodate different hair types and thicknesses.

Bordering each end of the set of prongs 46 could be a respective open-ended lockup channel 50 that receives corresponding lockup inserts 102 from the extension applicator's extension assembly 72 to readily provide for a removable or reversible attachment of the binding comb 32 to the extension applicator 70. The binding comb 32 could further feature a handle-operated clamp 52 comprising a clamp paddle being held by a rod 58 and movably traversing through the comb handle 34 to a clamp handle 60, the clamp handle may have a parallel orientation to the clamp paddle. A comb spring 62 could further bias the clamp paddle 54 (which could further support a clamp blade 56) into a resting or closed position A wherein the clamp paddle 54/clamp blade 56 is laid down upon the top of the prong section 44 behind the prong set 46. By generally rotating the comb handle 60 in one direction, the clamp paddle 54/clamp blade 56 can be pivoted upwards into an open position B away from the prong section 44. The comb handle 60 can be rotated in the other direction (e.g., be released), the comb spring 62 generally biasing the comb handle to otherwise pivot downwards to come to rest upon the prong section 44 in closed position B. In the open position A, collected hair strands 402 that may be separated apart from one another by the prongs 46 can then be laid upon the top of the prong section 44. When moving to the closed position B, the clamp paddle 54/clamp blade 56 may come down upon the individual hair strands 402 to hold the hair strands 402 secure between the prong section 44 and the clamp paddle 54/clamp blade 56 thereby substantially holding the hair strands 402 in place in their respective interstitial comb space 49 (e.g., each interstitial comb space 48 generally holding its own single individual hair strand 402.)

Figure 3:
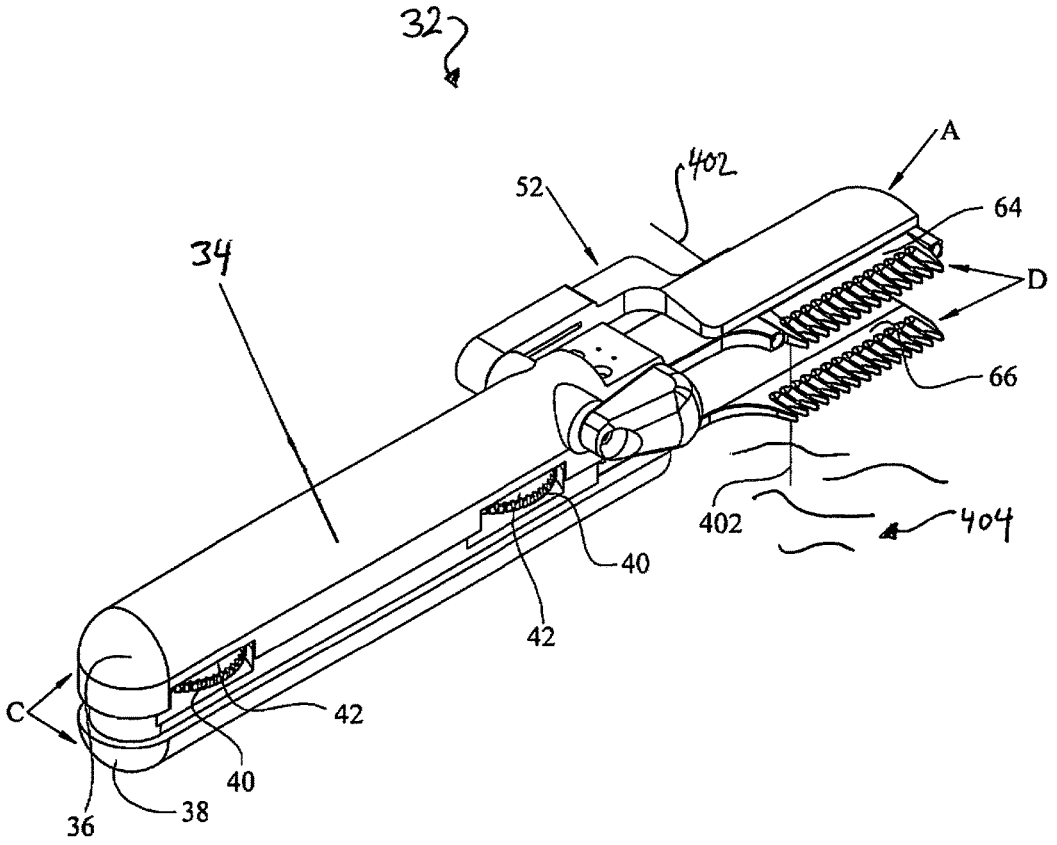
FIG. 3 is substantially a perspective cutaway view of a second embodiment of the binding comb of the present invention.
Figure 3A:
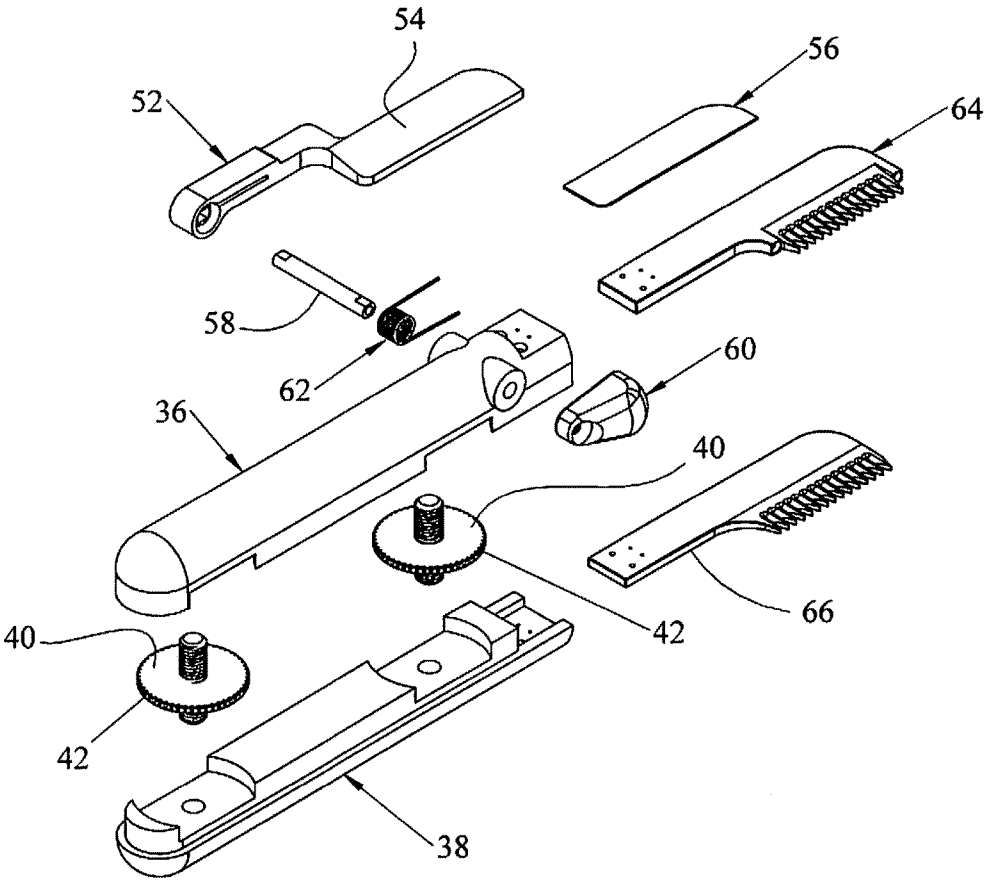
FIG. 3A is substantially a perspective exploded view of a second embodiment of the binding comb of the present invention.

As substantially shown in FIGS. 3, 3A another embodiment of the binding comb 32 could be structurally bifurcated for use with curly hair augmentation in which the bifurcated binding comb 64 may help straighten out individual curly hair strands 402 for a more positive interaction with the extension assembly 72. In this bifurcated embodiment, the comb handle 34 could be split-in-two along its length into an upper handle half 36 and a lower handle half 38. The upper handle half 36 could removably support one or first or top prong section 64 as well as movably support a comb clamp 52. The lower handle half 38 could removably support another or second or bottom prong section 66. Generally both such prong sections 64, 66 could share structural characteristic for separating and holding hair strands 402 of a certain curly hair type.) The both prong sections 64, 66 could be held in a spaced-apart and congruently parallel orientation to one another.

The two handle halves 36, 38 could be connected together by a set of threaded fasteners 40. The threaded fasteners 40 can each be bisected by a knurled thumb disc 42 so that a threaded fastener portion on one side of the disc 42 could have a thread rotation (e.g., American thread) that is the opposite to the thread rotation (e.g., French or reversed thread) on the remaining threaded fastener portion. The thumb discs 42 can be simultaneously rotated (e.g., generally in same direction and the same amount to prevent binding) to uniformly control the movement of the threads moving into or out of the two handle halves 36, 38, which generally controls the distance C between the two handle halves 36, 38 and distance D between the two prong sections 64, 66. In operation, the threaded fasteners 40 can then be engaged to separate the upper and lower handle halves 36, 38 apart and separate the two prong sections 64 or 66 apart. The length of separation D between the two prong sections being sufficient to allow removably connection between the binding comb 32 and the extension assembly 72; to generally facilitate the contacting of the top of the extension assembly 72 with the top prong section 64; to generally facilitate contacting the bottom of the extension assembly 72 with the bottom prong section 66; and to generally facilitate the bottom of the extension assembly 72 being able to come to rest upon the scalp during operation.

The bottom prong section 64 may engage a hairline so each of its interstitial comb spaces 48 generally only engages a single curly hair strand 402 from a hairline. The comb clamp 52 can be placed in the open position B, so that individual curly hair strands 402 from the bottom prong section 66 can be moved into the corresponding top prong section's interstitial comb spaces 48. The comb clamp 52 can then be placed into the closed position A to generally hold the individual curly hair strands 303 in place within the binding comb 32 and to present the curly hair strands 402 for proper contact with the extension assembly 72.

Figure 4:
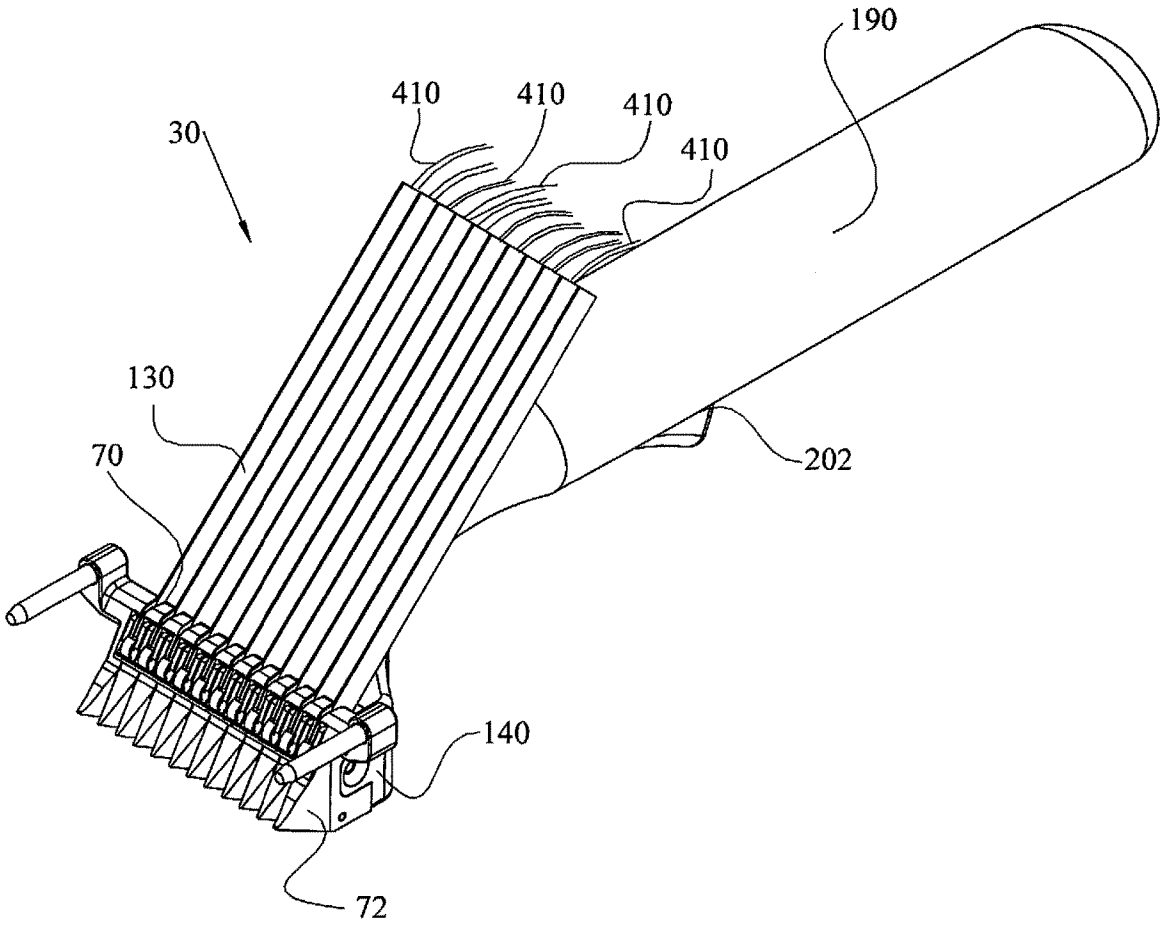
FIG. 4 is substantially a perspective view of the extension applicator of the present invention.
Figure 5:
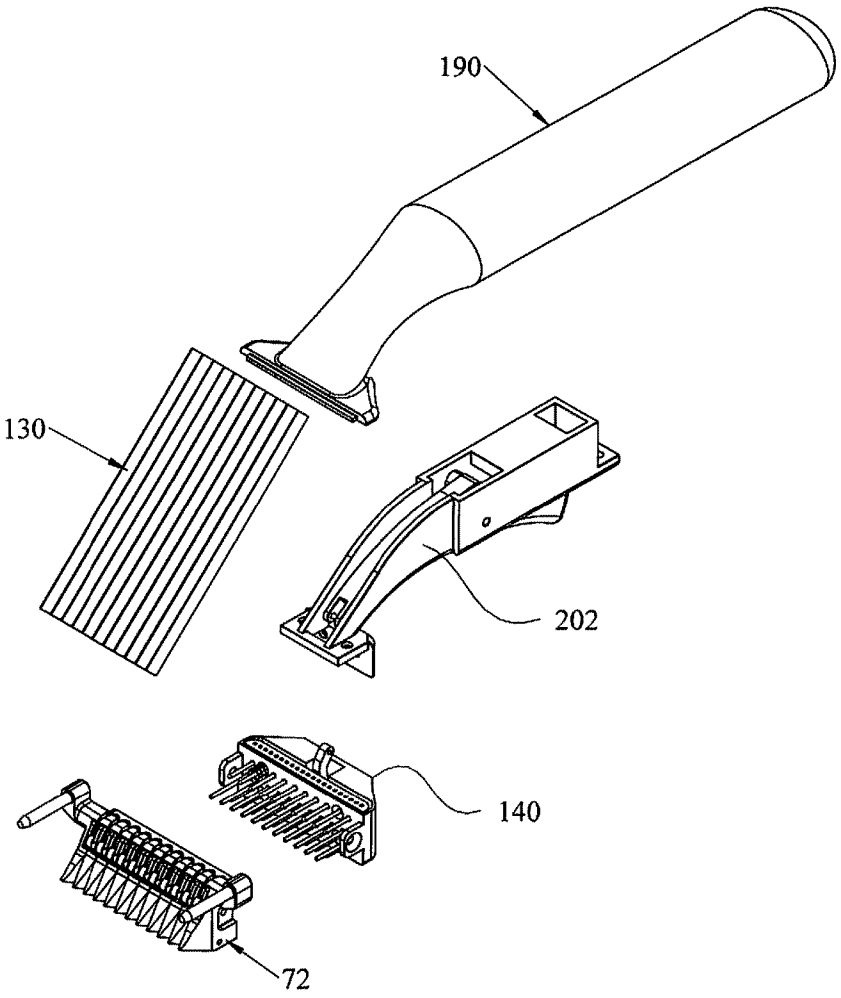
FIG. 5 is substantially a perspective exploded view of the extension applicator of the present invention.
Figure 5A:
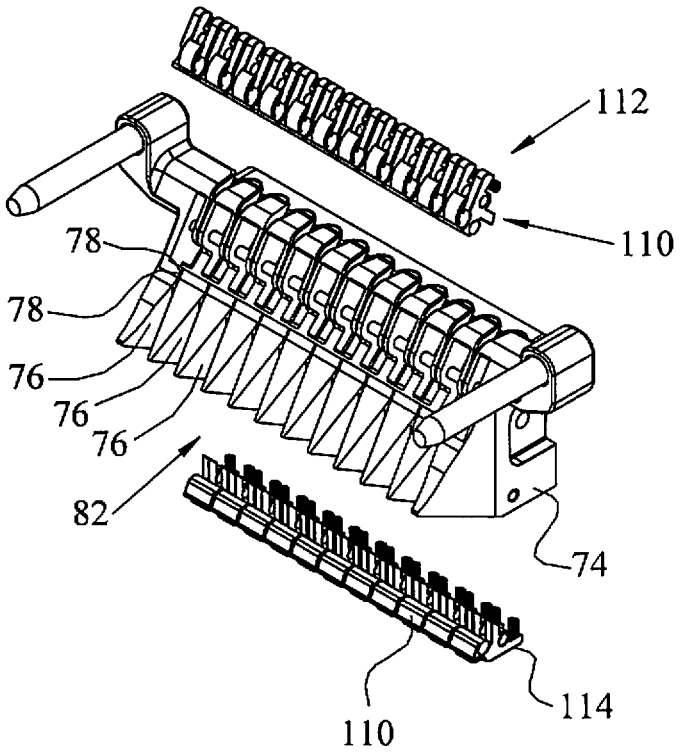
FIG. 5A is substantially a perspective exploded view of the extension assembly of the present invention.

As substantially shown in FIGS. 4 and 5, the extension applicator 70 could comprise an extension assembly 72 that may connect to a handle 190 by an ejection assembly 140; the handle 190 could further support a trigger assembly 202 that may connect to the ejection assembly 72; and a tube bank 130 generally holding a set of hair extensions 410 to be fed into the extension assembly 72.

Figure 6:
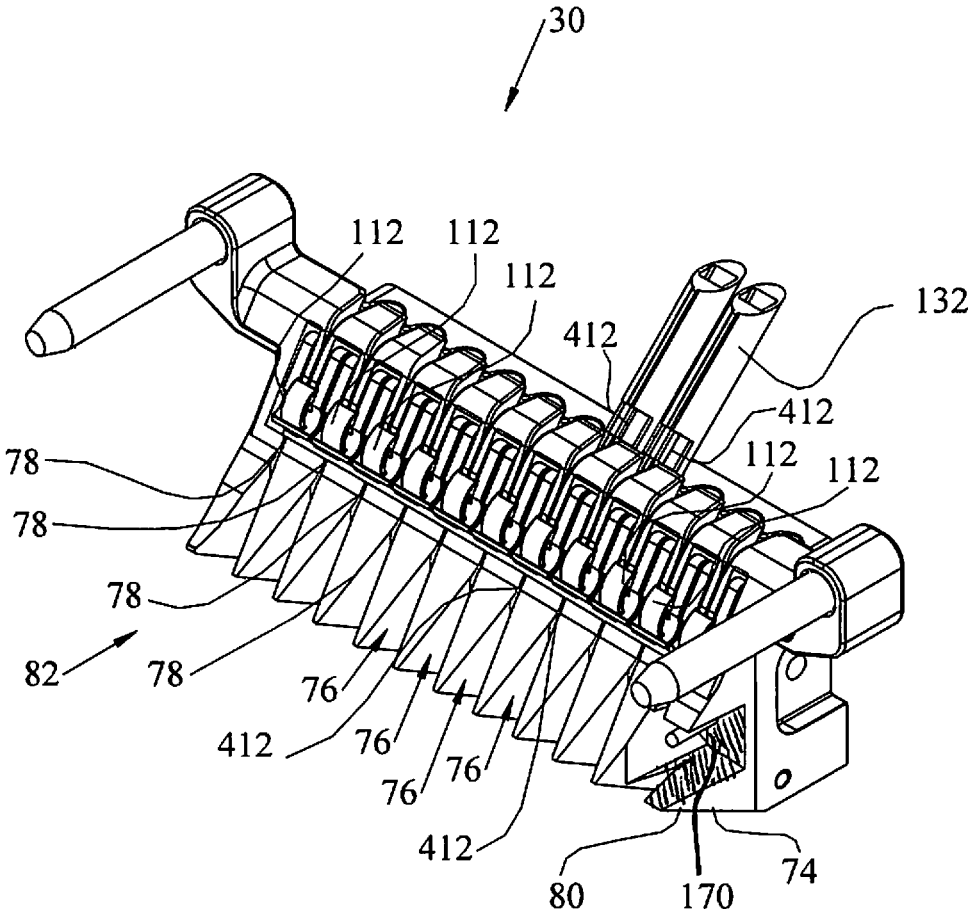
FIG. 6 is substantially a perspective cutaway view of the extension assembly of the present invention.

As substantially shown in FIG. 6, the extension assembly 72 could comprise an extension body 74 that pivotally supports two sets of levers 110. The extension body 74 could define a set of vertical-oriented extension grooves 76 that support extension tips 412 fed in from the tube bank 130. The extension assembly 72 could further movably support a set of top levers 112 at the top groove tips 78 of the extension grooves 76 and a set of bottom levers 114 at the bottom groove tips 80 that can be used to contain the extension tips 412 within the extension grooves 76. Operative pins 170 from the ejection assembly 140 could pass through the extension body 74 to generally open put on the groove side 82 to generally operate the levers 110 as well as eject any extension tips 412 placed in the extension grooves 76 (substantially shown in FIGS. 8 and 8A.)

Figure 7:
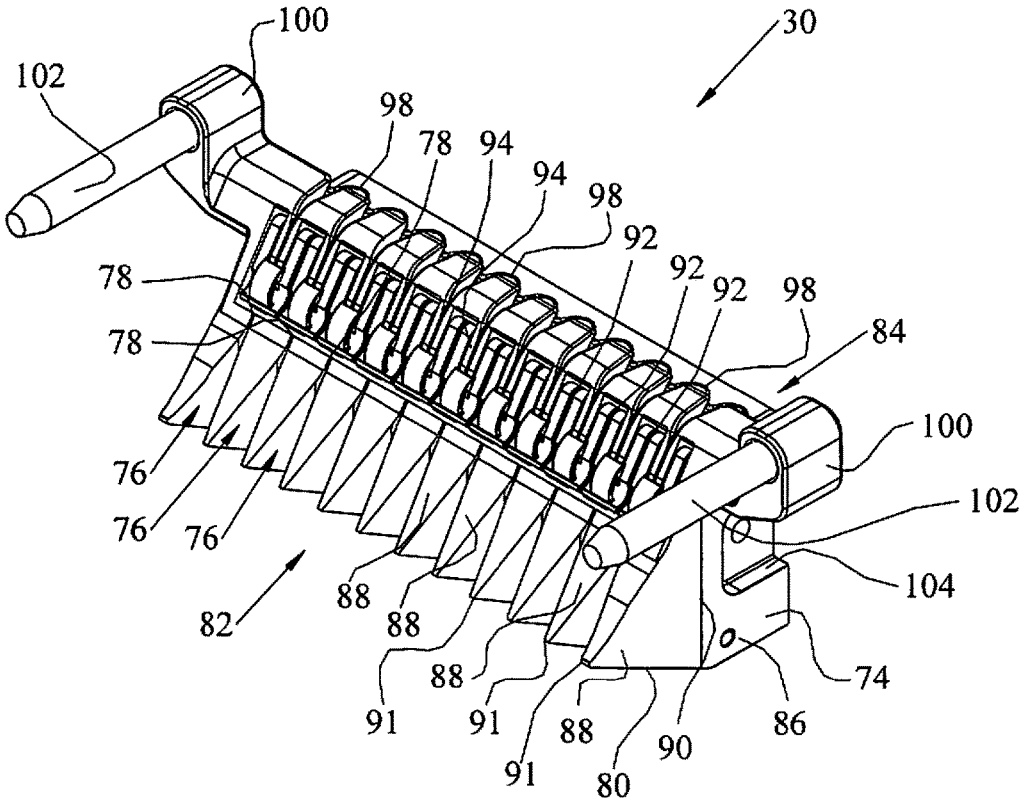
FIG. 7 is substantially a perspective view of the extension body of the present invention.

As substantially shown in FIG. 7, the extension body 74 could be block-shaped with a groove side 82 and a pin side 84 connected by side ends 86. The groove side 82 could substantially define the V-shaped vertical extension grooves 76 as being substantially located alongside one another, the extension grooves 76 generally being formed by a series of wedges 88 that are substantially held in a parallel orientation upon the groove side 82. The wedges 88 could have their bases 90 connecting to one another but are otherwise held apart from one another by their respective tips 91, the tips 91 generally being thinner than the bases 90. The extension grooves 76 could terminate at top and bottom groove tips 78, 80, respectively.

Proximate to the top and bottom groove tips 78, 80 could be further located sets of vertically oriented pairs of lever plates 92 used to moveably support the levers 110 (generally shown in FIG. 6) substantially in placed proximate the top and bottom groove tips 78, 80. The lever plates 92 of a pair could slightly held apart from one another to form a gap or plate channel 94 through which an extension tip 412 for an extension groove 76 may pass through (as substantially shown in FIG. 6.). The arrangement of levers 110, lever plates 92, plate channel 94 generally mirroring the arrangement of those levers 110 (generally shown in FIG. 6) lever plates, plate channels found proximate to the bottom groove tips 80.

Each lever 110 may be moveably connects to and straddles a plate pair 92 to generally locate a pair of spaced-apart support arms 120 and a pair of spaced-apart spring arms 122 of the lever 110 along the outer sides of the plate pair 92. A lever rod 96 passing though the extension body 74, the plate pairs 92 and set of levers 110 may allow the respective lever 110 to rock or pivot about the straddled plate pair 92. One lever rod 96 could be used to generally movably secure the top levers 112 while another lever rod 92 could be used to generally movably secure the bottom levers 114. (As substantially shown in FIG. 10.)

At the top of the assembly body 74, proximate to groove side 82 could be a set of linearly arranged tube pockets 98 to which the tube bank 130 (as generally shown in FIG. 4) could be removably and angularly attached in a manner that presents the extension tips 412 as held by the tube bank 130 to their respective top plate channels 94 (as generally shown in FIG. 6.).

At each end of the set of extension grooves 76 could be respectively a horn 100 that forwardly projects a lockup insert 102 that respectively engages the binding comb's lock up channel 50 to align and bring the binding comb 32 and extension assembly 72 together. The lockup inserts 102 could also respectively engage the alignment tubes 252 of the adhesive applicator 240 to substantially align and bring the adhesive applicator 240 and extension assembly 72 together.

On the side ends 86 proximate to pin side 84 could be located a pair of recesses 104 that could accept locating tabs 152 from the ejection assembly body 142 to help locate the ejection assembly body 142 upon the pin side 84.

Figure 8:
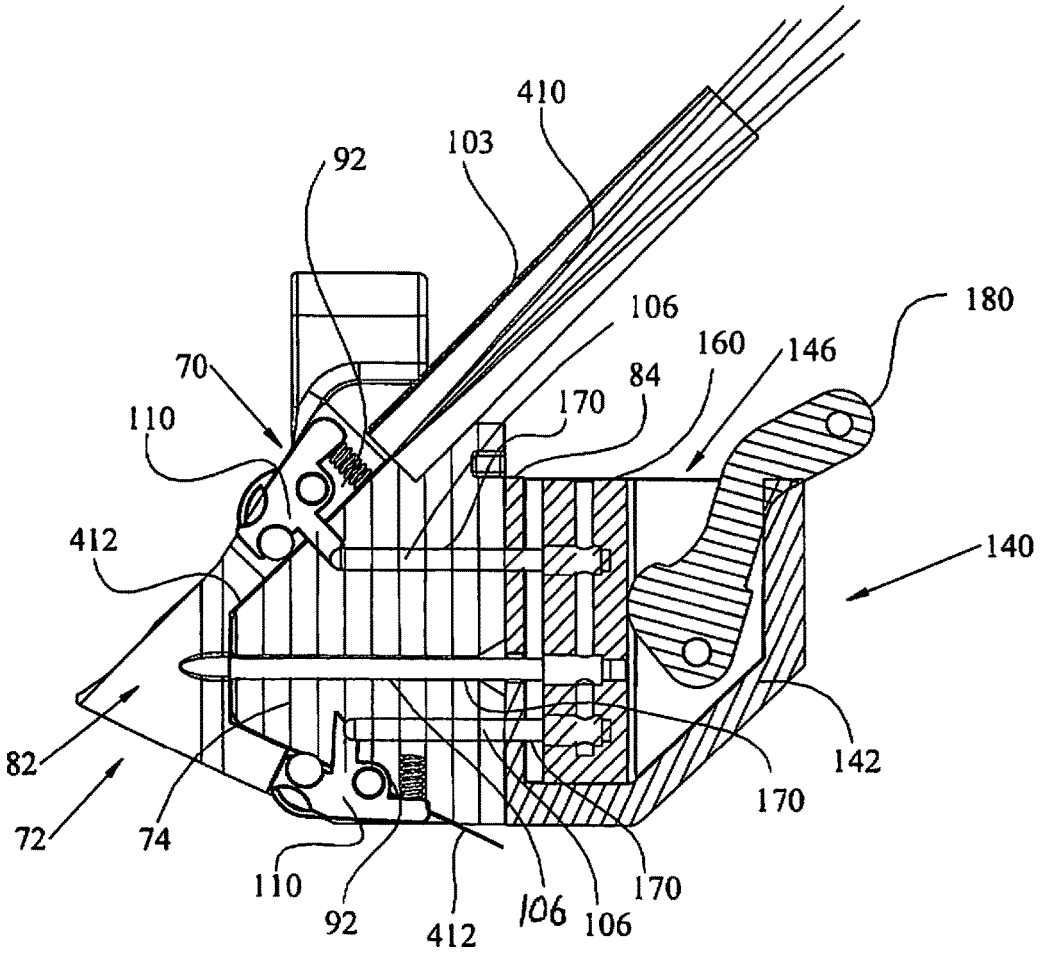
FIG. 8 is substantially a side elevation cutaway view of the extension body showing operative pins within their pin channels of the present invention.
Figure 8A:
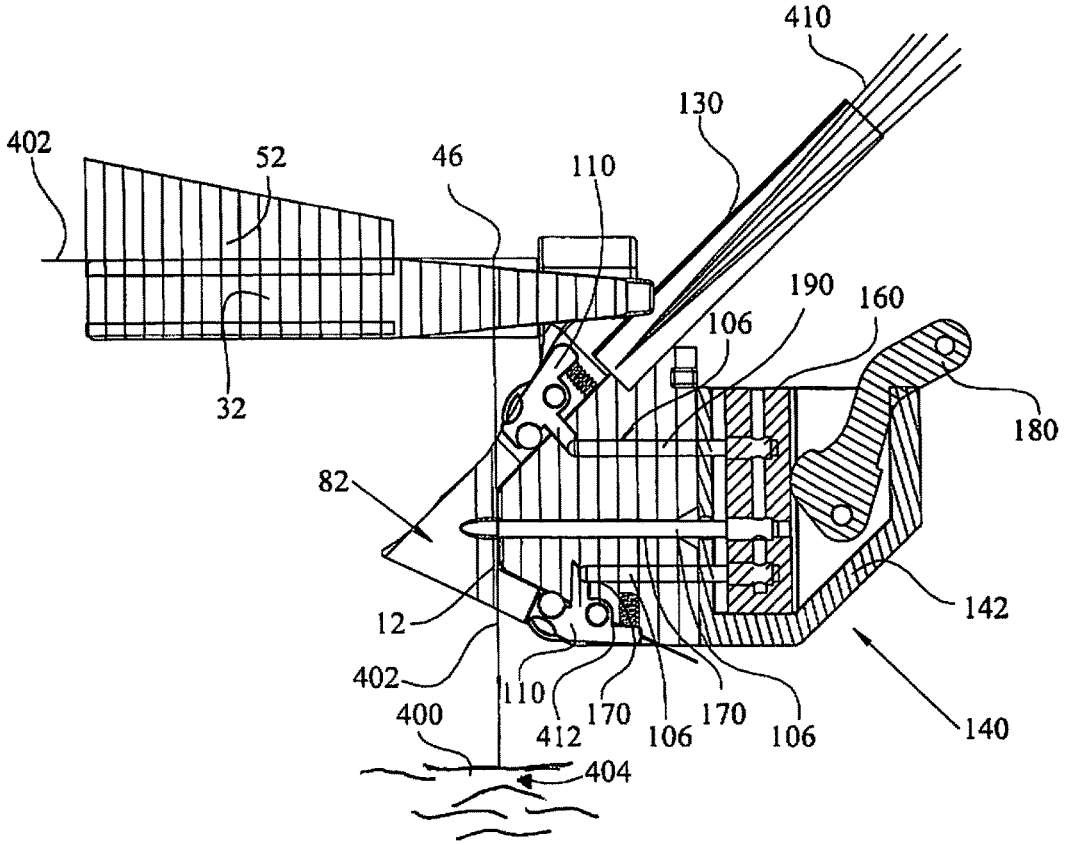
FIG. 8A substantially a side elevation cutaway view of the extension body and binding comb of the present invention removably connected together to show the combining by extension adhesive of a hair extension and hair strand.

As substantially shown in FIGS. 8 and 8A, three sets of double open-ended pin channels 106 could traverse the extension body 74 to respectively open out on both the groove and pin sides 82, 84. More specifically on the groove side 82, a top set of pin channels 106 could open out proximate to the top groove tips 78 (behind the top levers 112); a middle set of pin channels 106 could open out at the middle 81 of a respective extension groove 76 and a bottom set of pin channels could open proximate to the bottom groove tips 80 (behind the bottom levers 114.) The three sets of pin channels 109 could receive and movably hold three respective sets of operative pins 170.

Operative pins 170 in top set of pin channels 106 could be used to operate the set of top levers 112 while the operative pins 170 laid in the bottom set of pin channels 106 could be used to operate the set of bottom levers 114. Activation (e.g., impingement) of the levers 110 by the operative pins 170 could otherwise release the hair extensions tips 412 held in place in the respective extension grooves 76 by the top and bottom levers 112, 114. The pin channels 106 for the levers 110 could open up on the non-plate channel sides of the lever plate pairs 92. In doing so, one operative pin 170 for such a pin channel 106 could act upon a pair of adjacent levers 110. The adjacent lever pair 110 could further form a pair of adjacent support arms 120. The operative pin 170 acting upon the adjacent support arm pair 120 could simultaneously move the adjacent levers pair 110. The operative pins 170 held in the middle set of pin channels 106 could respectively be used to push or eject the extension tips 412 out of their respective extension grooves 76. The binding comb 32 may be brought into contact with the extension assembly 72 so that the hair strand 402 of the scalp 404 of the head 400 may be brought into contact with an hair extension tip 412 with an applied extension adhesive 12 to form a bounded hair strand/extension combination.

Figure 9:
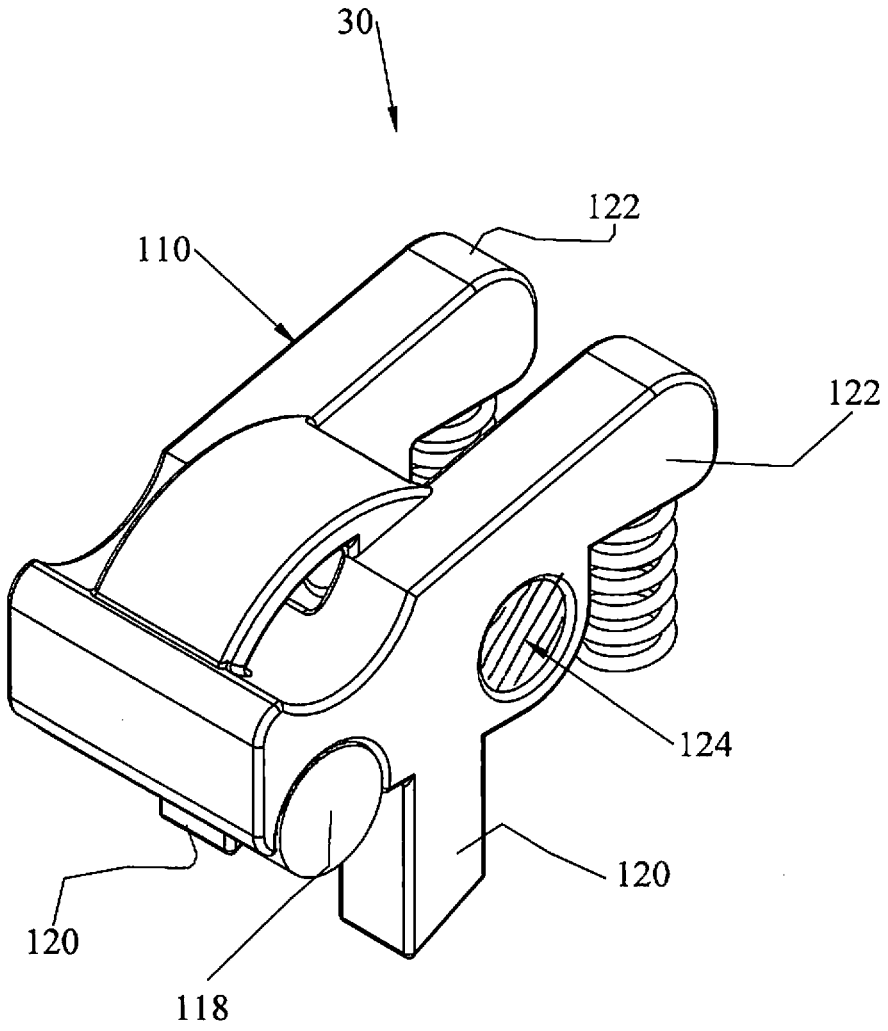
FIG. 9 is substantially a perspective view of lever of the present invention.
Figure 10:
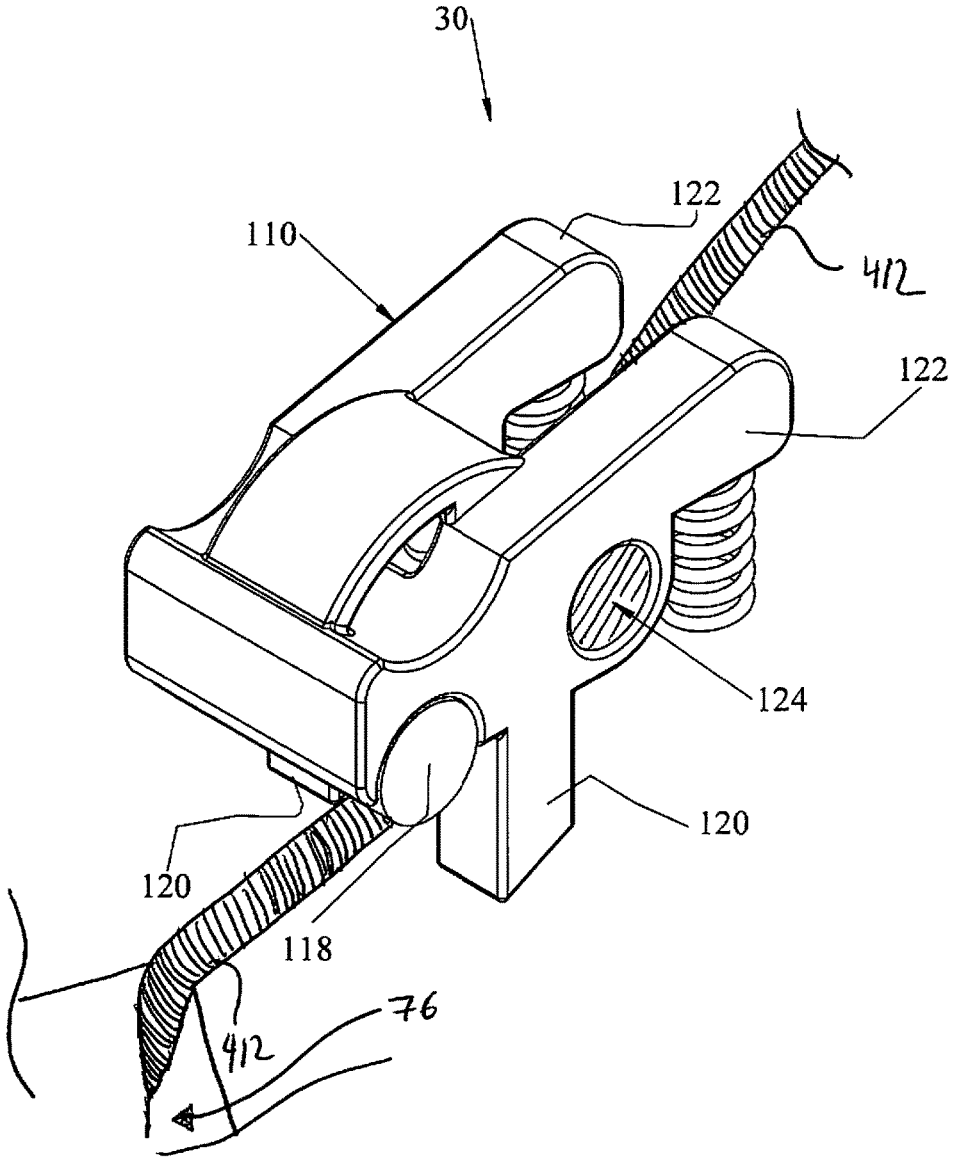
FIG. 10 is substantially a perspective cutaway of the lever straddling the lever plate pair and holding in place an extension tip.

As substantially shown in FIGS. 9 and 10, the levers 110 may share a common overall structure, namely a lever body 116 with a front section that may be laterally or traversely-grooved at the bottom to hold a silicon tube 118 for engaging the extension tip 412 as silicon tube 118 substantially passes between the lever 110 and groove tip. Behind the front section could be a pair of spaced-apart support arms 120 and a pair of spaced-apart spring arms 122, each support arm 120 generally connecting to a respective spring arm 122 in a substantially perpendicular manner. The intersection of the connected spring arm/support arm set one another could form rod apertures 124 through which the lever rod 96 passes through to pivotally connect the lever body 116 to lever plates 92. In this manner, the two sets of connected spring arm/support arm 122, 120 may further denote a hollow area between the two sets at the rear of the lever body 116 through which lever 110 can straddle its respective lever plate pair 92. An extension tip 412 guided by the plate channel 94 can pass underneath the lever 110 to where the silicon tube 118 when lowered into place can resiliently deform to hold the extension tip 412 in place against the respective groove tip without generally damaging the extension tip 412. The support arms 120 can be engaged by their respective operative pins 170 to generally push back open or rock up the lever 110; to substantially bring the silicon tube 118 out of engagement with the extension tip 412; and generally release the extension tip 412 to be move out of or into its extension groove 76. The spring arms 122 respectively support biasing devices, such coil lever springs 126, that may rest upon the groove tip 78, 80 to general dispose the lever 110 forward and substantially bring the silicon tube 118 into contact with the groove tip 78, 80 (and/or the extension tip 412 within the groove tip 78, 80.)

Figure 11:
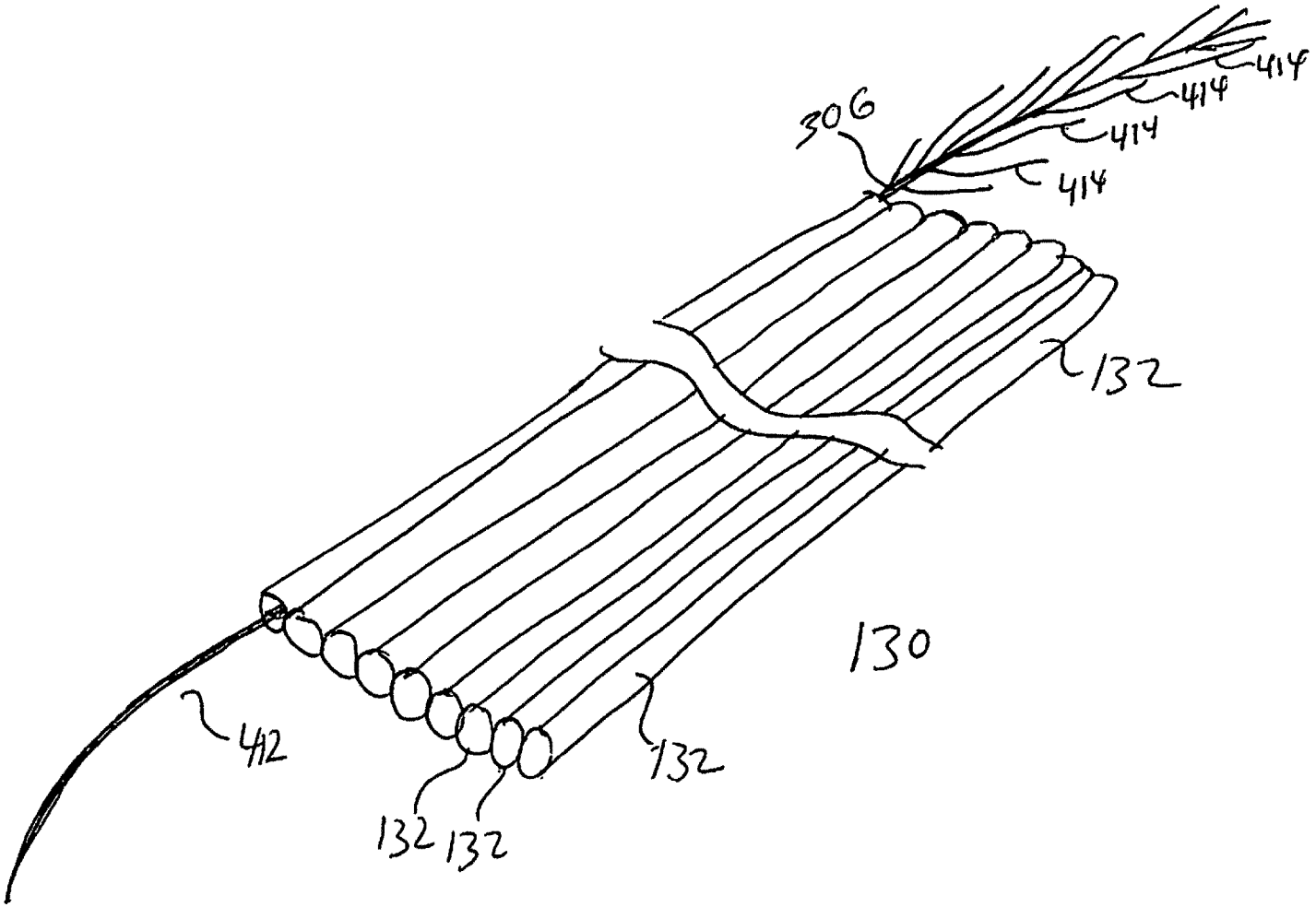
FIG. 11 is substantially a perspective view of the tube bank of the present invention.

As substantially shown in FIG. 11, the tube bank 130 could comprise a set of double open-ended, hollow clear tubes 132 that are adjacently held together along their respective sides. Each hollow interior of the tube 132 could movably support a core hair extension 410. In certain versions, additional hair extensions 414 that may have been bonded to the core hair extension to generally be organized like a feather or tree-like structure. The extension tip 412 could protrude out of the bottom end of the tube 132 so that when the tube bank 130 is inserted into the tube pockets 98, the extension tip 412 may be grasped and fed into the plate channel 94 of the lever plate pair (as substantially shown in FIG. 6).

To accomplish this maneuvering, the lever 110 may manipulated by delicate tweezers or similar tools (not shown) to rock the lever 110 back into the open position to allow the passage of the extension tip 412 into the extension groove 72. As generally shown in FIG. 6, once in place, the top lever 112 may then dropped back down upon the extension tip 412 to hold at least portion of the extension tip 412 in place in the extension groove 76. The extension tip 412 then can be brought down through the extension groove 76 to the corresponding bottom lever 114. There the bottom lever 116 can similarly be manipulated like the top lever to allow the introduction of the extension tip 412 past the bottom lever's silicon tube 118 and then into plate channel 94. Upon release of the bottom lever 114, the extension tip 412 could be securely retained within the extension groove 76 by both top and bottom levers 112, 114. (As substantially shown in FIG. 8.)

Figure 12:
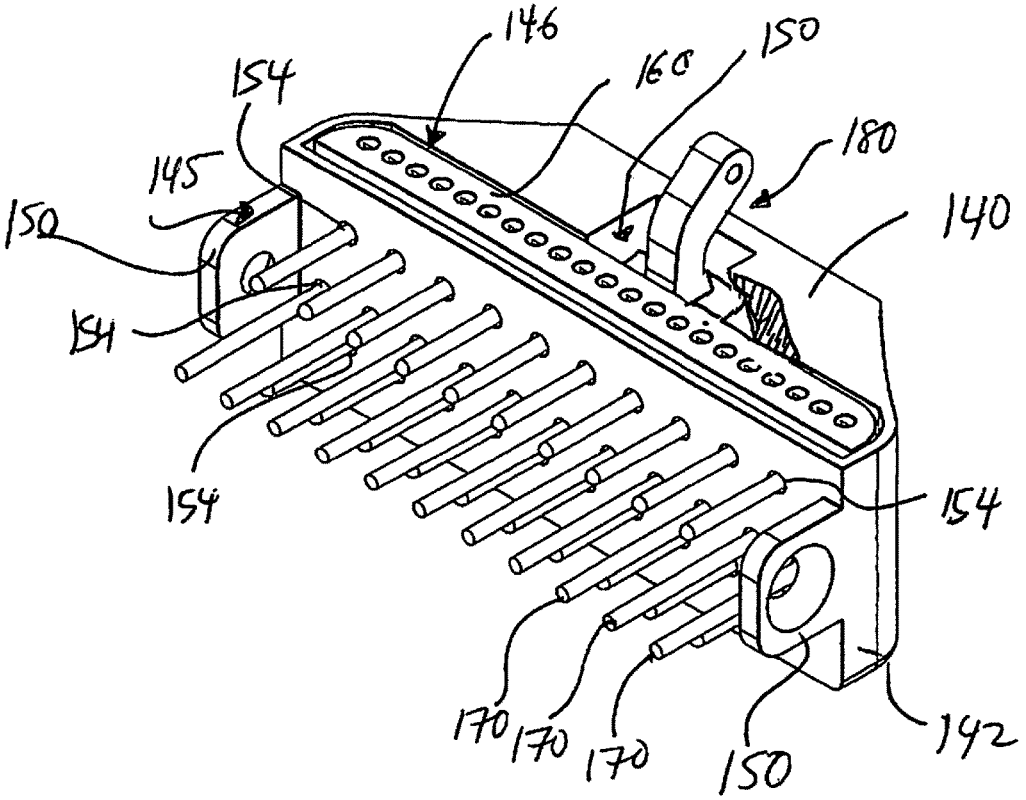
FIG. 12 is substantially a perspective cutaway view of the ejection assembly of the present invention.
Figure 13:
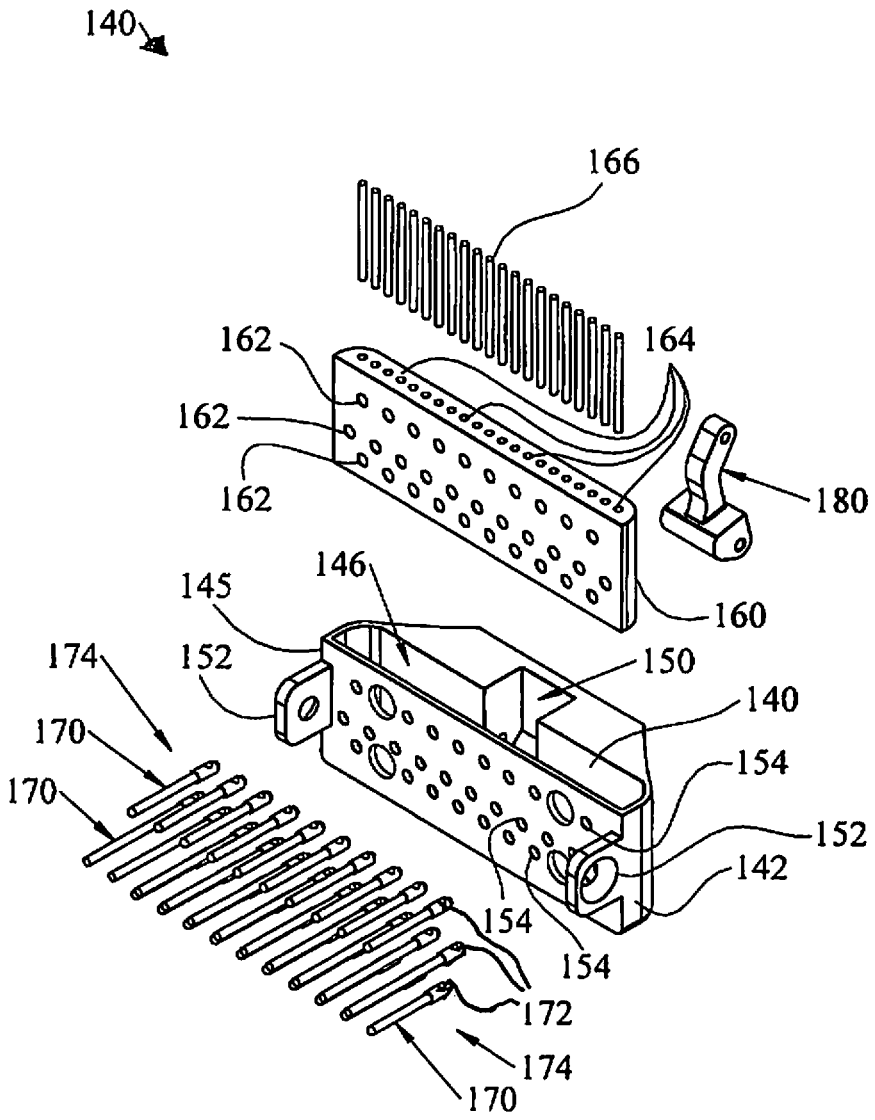
FIG. 13 is substantially a perspective exploded view of the extension applicator of the present invention.

As substantially shown in FIGS. 12 and 13 the ejection assembly 140 could comprise an ejection assembly body 142 that could form an open-topped, T-shaped channel 146 that movably contains a pin plate 160 and a trigger foot 180. The ejection assembly body's front side 145 could feature three sets of operative pin apertures 154 that continuously connect the assembly body's front side 150 to the interior of the head portion 150 of the T-channel 146. Each of two side edges of the front side 145 could further support two spaced-apart locating tabs 150 that fit into locating recesses 104 of extension assembly 140 (as substantially shown in FIG. 7). Tapered apertures in each of locating tabs 150 could be used to direct taper-headed fasteners into the extension assembly 70 that may be used to hold the ejection extension assembly's front side 145 against the extension assembly's pin side 84 (as substantially shown in FIG. 4.)

The pin plate 160 further mounts the three sets of operative pins 170 by their pierced ends 174 to allow the operative pins 170 to ride in the extension assembly's pin channels 106. When the trigger foot 180 hits or impinges upon the back (e.g., a non-pin side) of the pin plate 160, the pin plate 160 moves within the ejection assembly body 142 and toward the extension assembly 72. This forward movement further moves the operative pins 170 along the extension assembly's pin channels 106 to open the top and bottom levers 112, 114 and to act directly upon the extension tips 412 (e.g., as adhesively bonded to hair strands 402) to further substantially eject them (e.g., the bound combination of extension and hair strand) from their respective extension grooves 76 (as substantially shown in FIG. 8A.)

The pin plate 160 may be generally rectangular in shape and be vertically located within the T-channel's arm portion 150. One side of the pin plate 160 may define three sets (e.g., top, middle and bottom) of recesses or pin cups 162 with each set of pin cups 162 being horizontally arranged lengthwise upon the pin plate 160 so each pin cup set 162 may be in a parallel configuration to the other pin cup sets 162. The pin plate 160 upon its top lengthwise edge may have a set of open-ended retaining pin channels 164 that passes through the pin plate 160 in a manner that an open-ended pin channel 164 will respectively pass into a top pin cup 162 and onto the bottom pin cup 162 directly below. Remaining pin channels 164 could respectively pass just through respective the middle pin cups 162 (i.e., in that the middle pin cups 162 may be offset from respective top and bottom pin cups 162 that generally sandwich the respective middle pin cup 162.)

Figure 14:
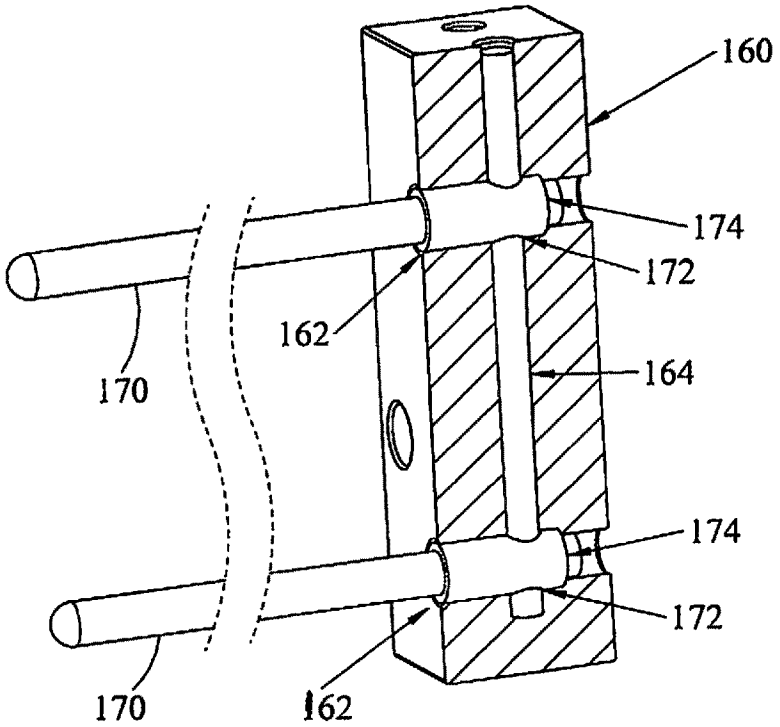
FIG. 14 is substantially a perspective cutaway view of the pin plate of the present invention.

As substantially shown in FIG. 14, each of the operative pins 170 could have a retaining pin aperture 172 traversing through near one end to create a pierced end 174.) When a pierced end 174 is generally inserted into a respective pin cup 162 of the pin plate 160, a locking pin 154 may be placed into corresponding pin channel's open end and then may pass down the into the pin channel 164. The locking pin then may pass into other pin cups 162 connected to the pin channel 164. In doing so, the locking pin 166 could pass through properly oriented pierced-ends 174 within the pin cups 162 to generally hold such traversed operative pins 170 captive to the pin plate 160. In this manner, a single locking pin 166 passing through a pin channel 164 connecting a top and bottom pin cups 162 can hold two operative pins within placed to their pin cups 162. By reversing the process, the operative pins 170 could be freed from the pin plate 160.

The connection of operative pin 170 to pin plate 160 could be done when the pin plate 160 is within the T-shaped channel 146 and the operative pins 170 can be inserted through the operative pin apertures 154 to reach back into aligned pin cups 162. The operative pin 170 could be oriented within the pin cup 162 to substantially allow the retaining aperture 172 of the pierced end 174 to align with the pin channel 164. A locking pin 166 could be inserted into the open end of the pin channel 164 can pass down and through the retaining aperture(s) 172 to substantially hold the operative pin(s) 170 captive by their pierced end(s) 174 to the pin plate 160.

As substantially shown in FIG. 13, the trigger foot 180 could comprise a wedge-shaped foot base 182, the top of which supports a curved arm 184. The trigger foot 180 could be movably pinned to the ejection assembly's body 142 within the T-shaped channel's body portion 148 to generally allow the trigger foot 180 to be substantially pivoted when the arm 184 may be activated (depressed) by the handle's trigger assembly 202. During this activation, the tip of arm 184 as pivotally connected to the trigger assembly 202 could be moved downward (e.g., backward) to pivot the trigger base into contact with the backside of the pin plate. This general impinging action (e.g., the foot base 180 generally not being movably attached to the pin plate 160) could move the pin plate 160 substantially towards the extension assembly 72; bring the operative pins 170 forward though the pin channels to move out of the extension assembly 72 to activate levers 110 and eject extension tips 412 from the extension grooves 76 (as substantially shown in FIGS. 8 and 8A.)

Figure 15:
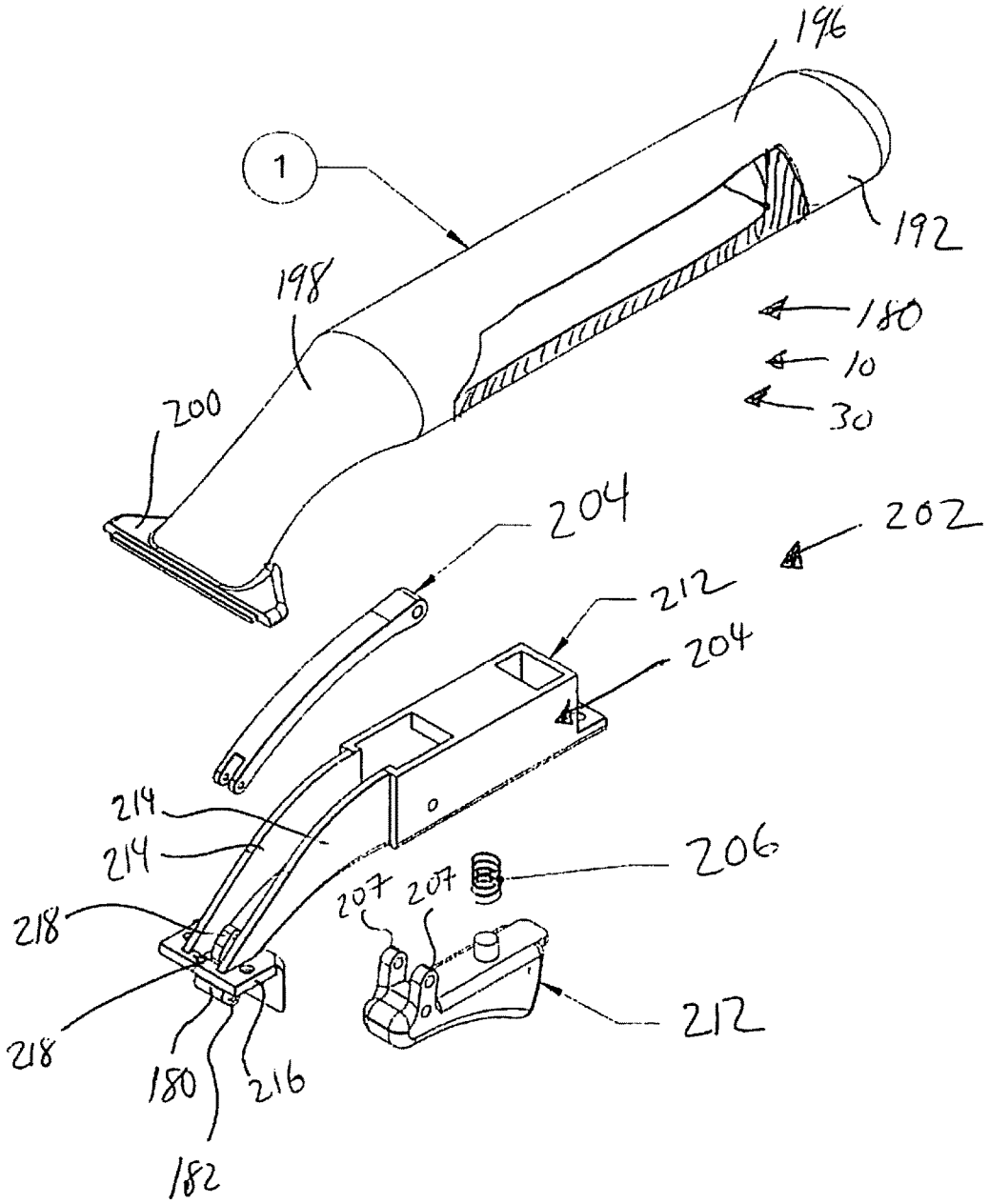
FIG. 15 is substantially a perspective exploded view of the handle of the present invention.
Figure 16:
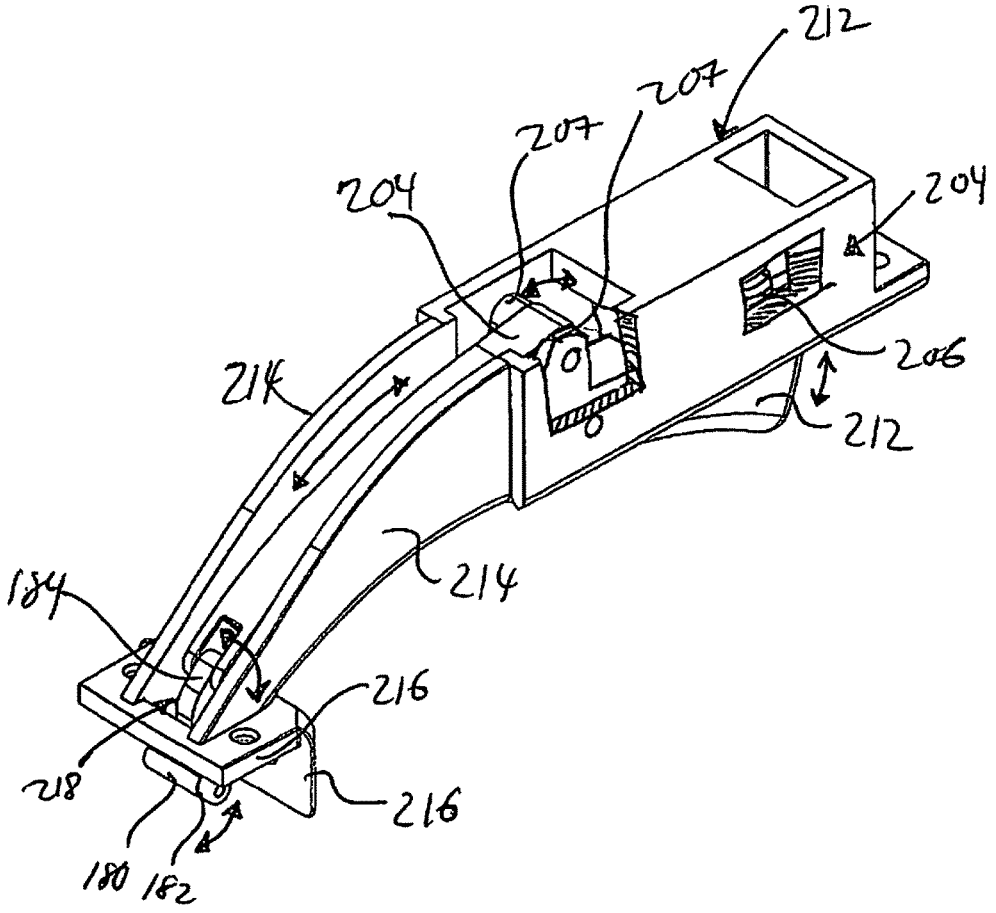
FIG. 16 is substantially a perspective cutaway view of the trigger assembly of the present invention.

As substantially shown in FIGS. 15 and 16, the handle 180 could comprise handle cover 192 having an assembly groove 194 containing the trigger assembly 202, which then forms the underside of a handle cover 192. The handle cover 192 could be segmented into a grip portion 196; extension portion 198 and attachment portion 200. The grip portion 196 could be seen as generally cylindrical, which may be grasped to manipulate the positioning of the extension applicator 70. The grip portion 196 may terminate at one end to connect to the extension portion 198 that angles downward from the grip portion 196. The extension portion 198 may then support at one end the triangularly-shaped attachment portion 200 that may be used to connect the handle 190 and trigger assembly 202 to the top of the ejection assembly 140 in a manner that substantially covers the open-topped T-shaped channel 146 (as substantially shown in FIGS. 4 and 5.)

The trigger assembly 202 could comprise a trigger body 204 movably holding a trigger 212, trigger link 204, and return spring 206. The trigger body 204 could a box-shaped trigger support 212 that may connect at one end to a pair of spaced apart arcuate arms 214. The other end of the arcuate arm pair 214 could connect an L-shaped attachment plate 216 in manner that substantially frames the sides of a plate opening 218 formed by the L-shaped plate 216 through which the trigger foot's arm 180 can protrude. The trigger 206 can be movably pinned at trigger's narrow end to the trigger body 204 allowing the other wider end of the trigger 206 (upon which the operator's finger[s] would rest—not shown) to hold a return spring 212 captive between the trigger 206 and the trigger body 204. The return spring 212 would bias the trigger 206 away from the trigger body 204 (e.g., to bias to the trigger assembly's "off" position.) Two-spaced apart trigger arms 207 straddling the sides of the trigger 206 at the top of the narrow end could further project upward and in between the arcuate arm pair 214 to be movably attached (e.g., pinned) to one end of the trigger link 208. The trigger link 208, movably located between the arcuate arm pair, could be movably connected to connect at trigger link's other end to the tip of the trigger foot's arm 184.

The trigger 206 may be squeezed at its wider end (e.g., moved against the bias of the trigger spring 210) and into the trigger support 212/handle 190; this action could cause the trigger arms 207 to forward; pushing the trigger link 208 forward and down upon the arm 184. As the arm 184 is generally moved down, the arm could pivots the trigger base 182 into the pin plate 160. The resulting movement of the pin plate 160 could further move the set of operative pins 170 further into their respective pin channels 164. The operative pins 170 could then contact and open the levers 110 as well as move into extension grooves 76 to substantially move any extension tips 412 out of the extension grooves 76. (As substantially shown in FIGS. 8 and 8A.)

Generally when the trigger 206 is released, the return spring 210 may substantially bias the wide end of the trigger 206 away from the trigger support 212 to respectively pivot or retract back the trigger support arms 207 to generally move the trigger link 208 backwards. As the trigger link 208 substantially moves backwards, trigger link 208 may pivot the arm 207 upward, generally bringing the trigger foot's trigger base 182 away from the pin plate 160 (as substantially show in FIG. 12.) Spring tension as substantially provided by the lever springs 126 upon the top and bottom levers 112, 114 may then exert sufficient force upon the operative pins 170 to generally push them backwards into the pin channels 106 so as to substantially move the pin plate 160 backwards in the T-channel 146 (substantially shown in FIGS. 8 and 8A.)

Figure 17:
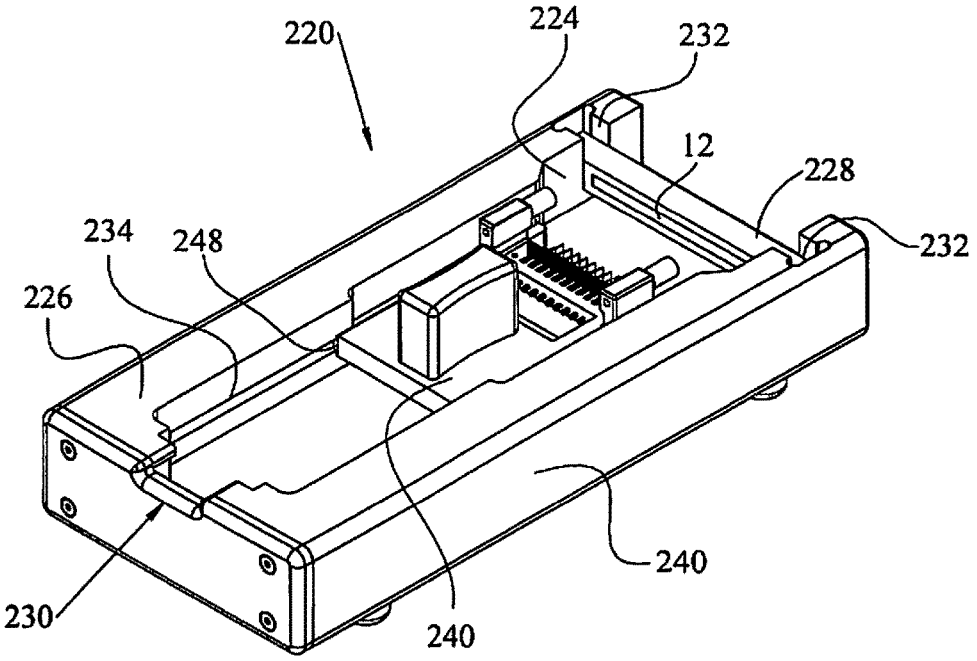
FIG. 17 is substantially a perspective view of the adhesive applicator and adhesive tray of the present invention.
Figure 30:
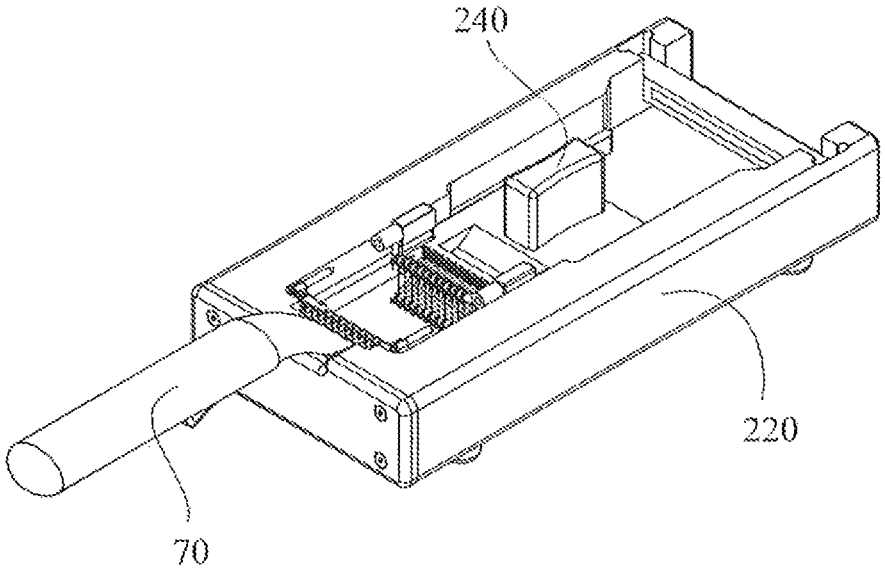
FIG. 30 is substantially showing the adhesive-loaded extension applicator moving into contact extension applicator to apply adhesive to extension tips held by the extension applicator.
Figure 31:
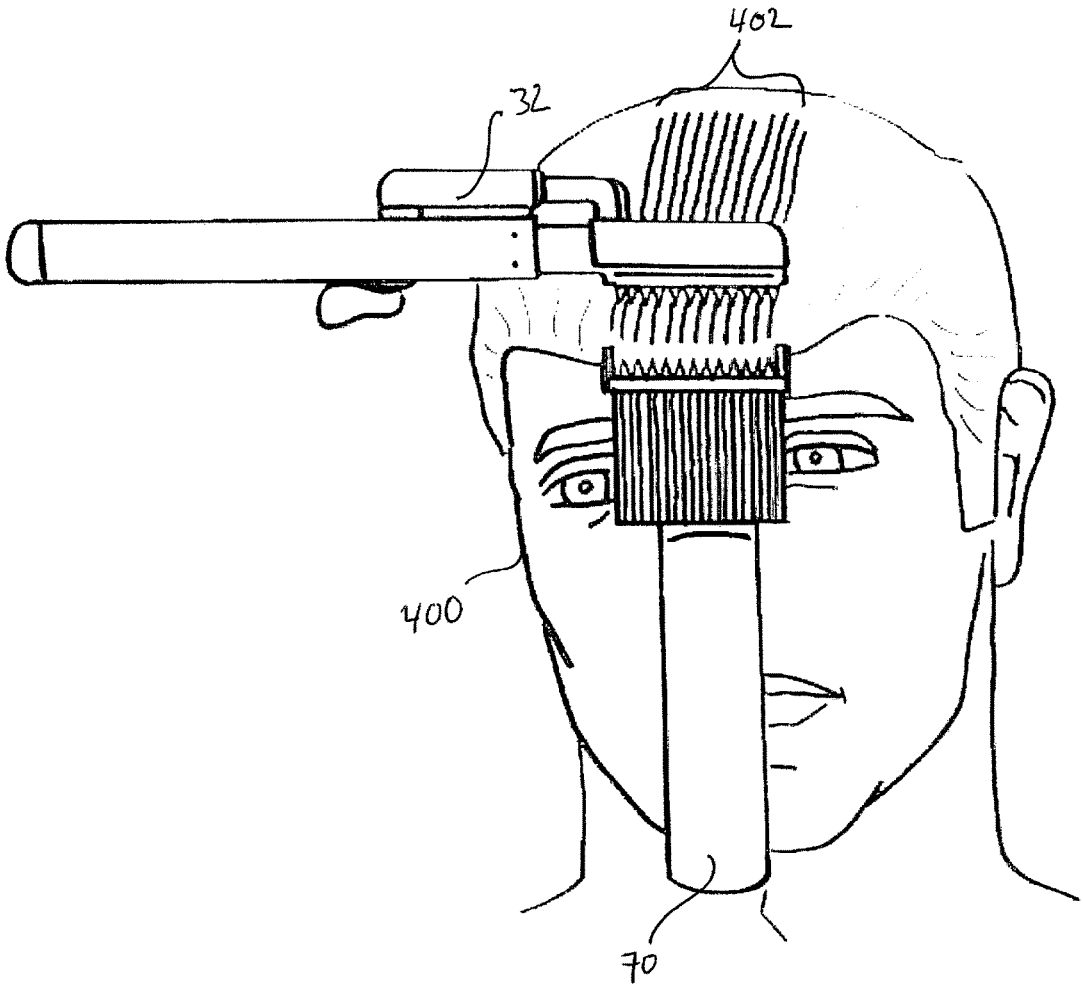
FIG. 31 is substantially showing the aligning of the extension applicator to the binding comb.
Figure 32:
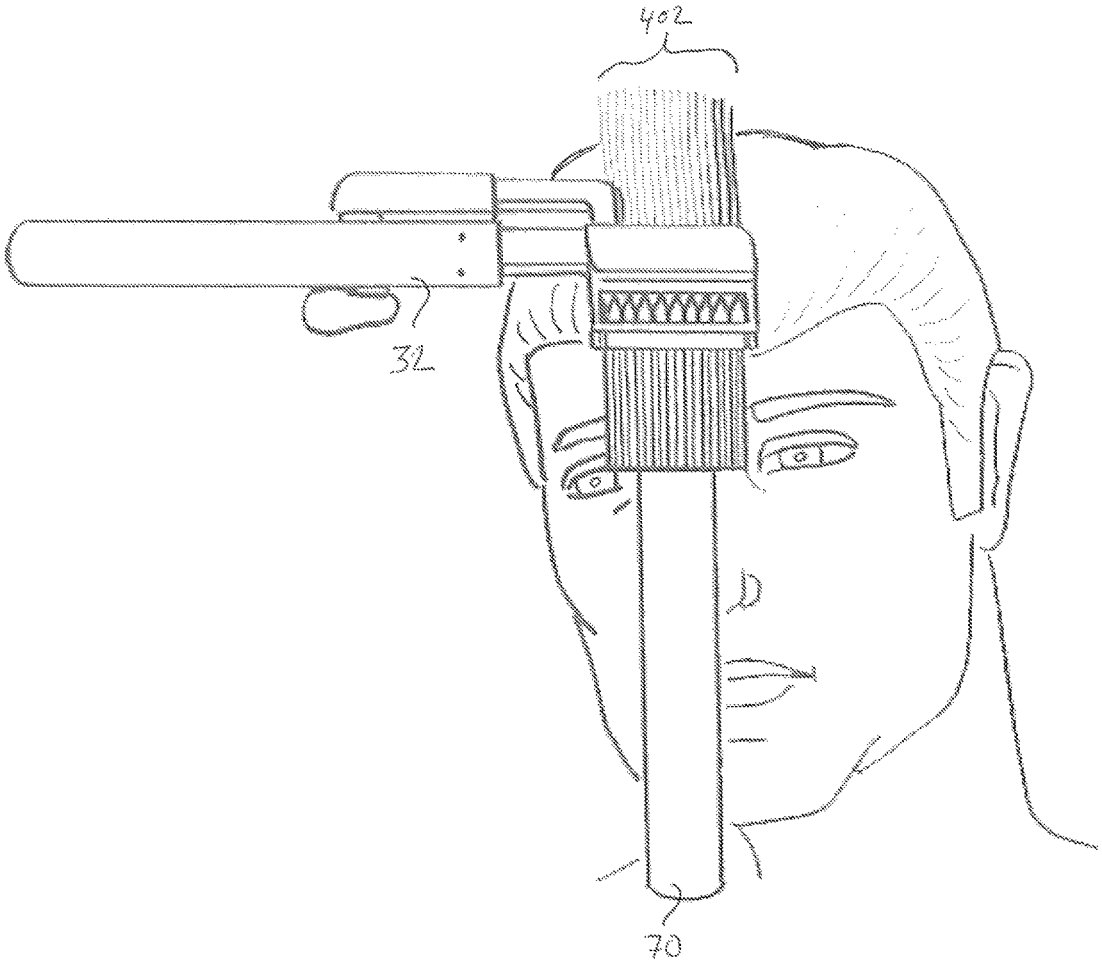
FIG. 32 is substantially showing the connection of the extension applicator to the binding comb.
Figure 33:
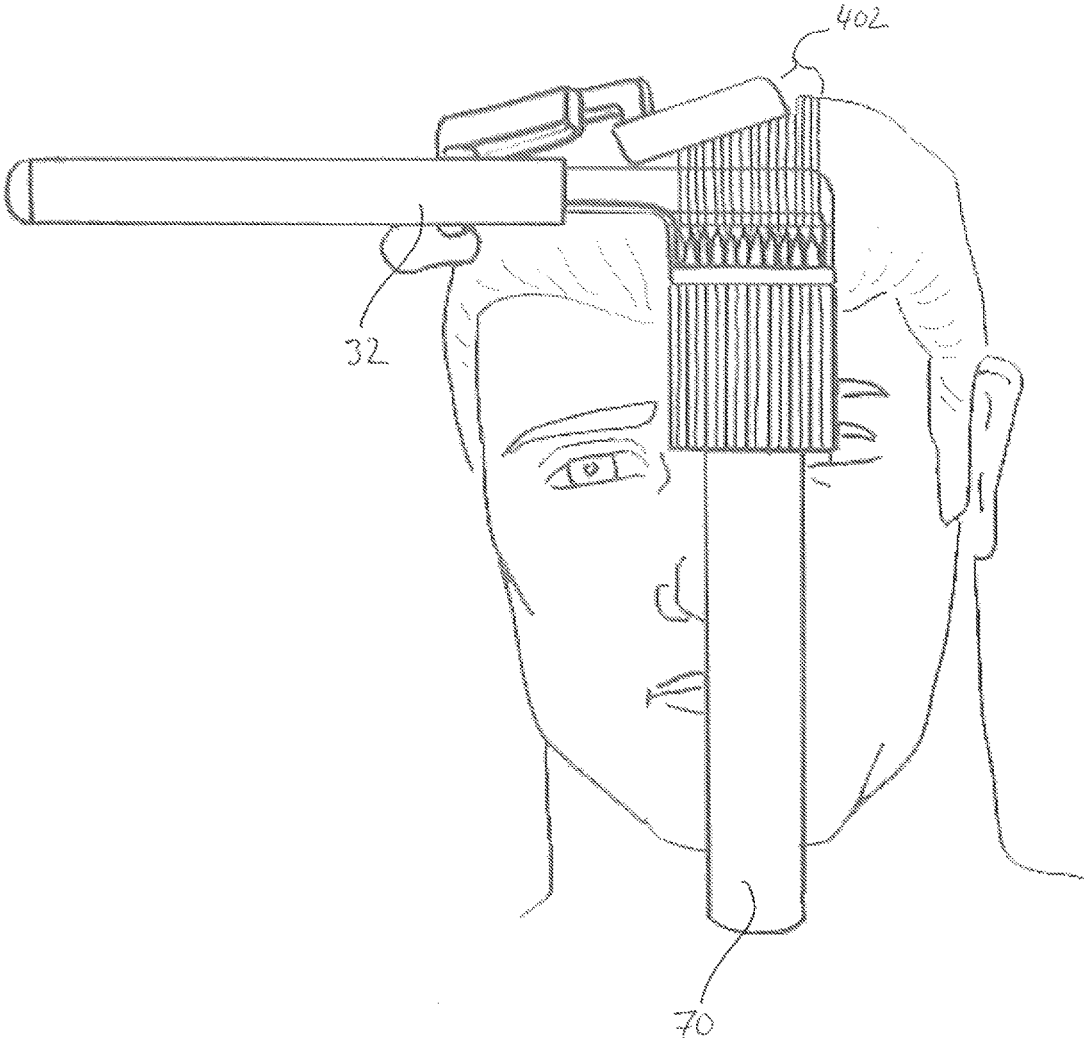
FIG. 33 is substantially showing the opening of the comb clamp of the binding com to release the hair strands.
Figure 34:
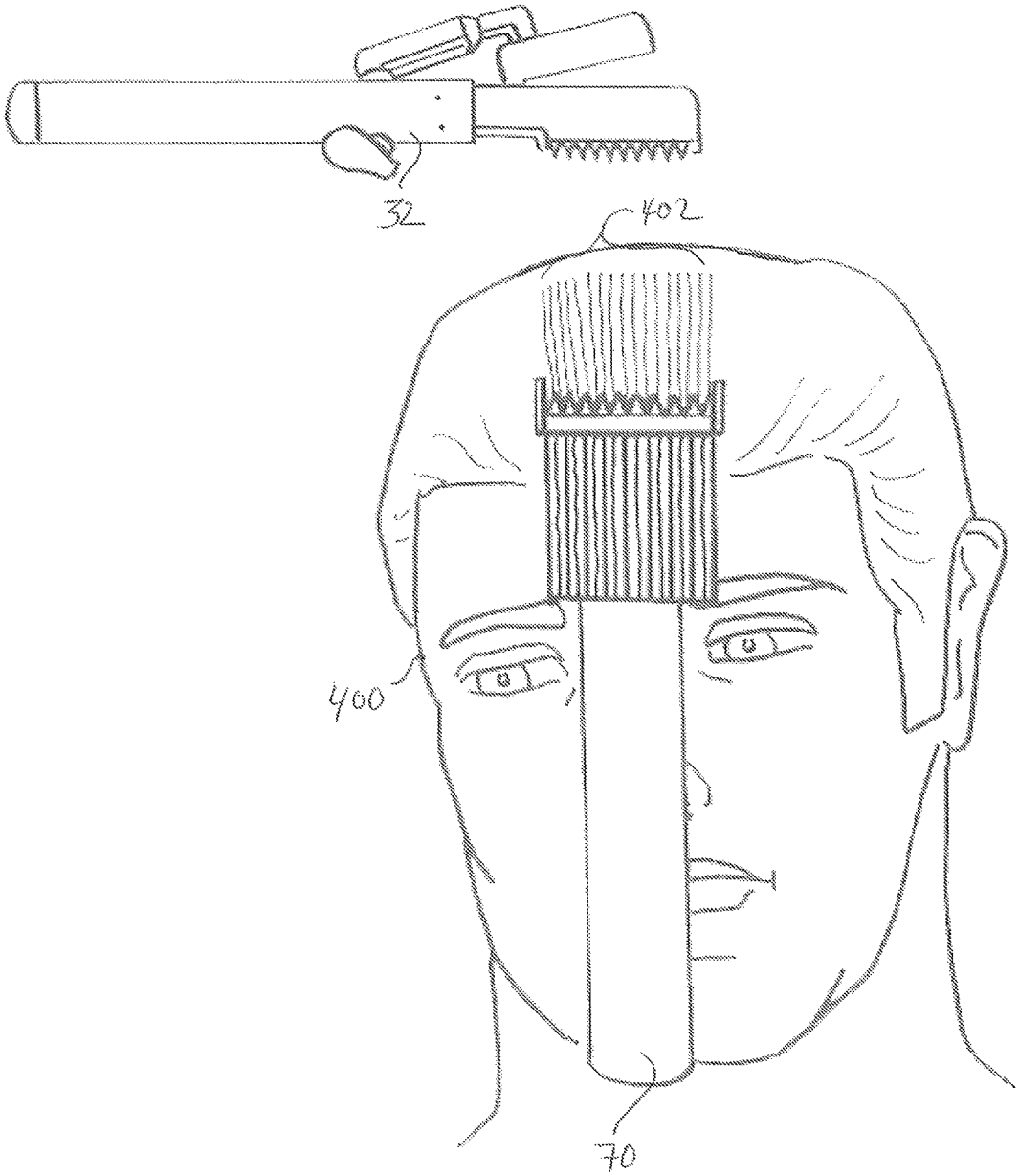
FIG. 34 is substantially showing the removal of the binding comb from the hairline.
Figure 35:
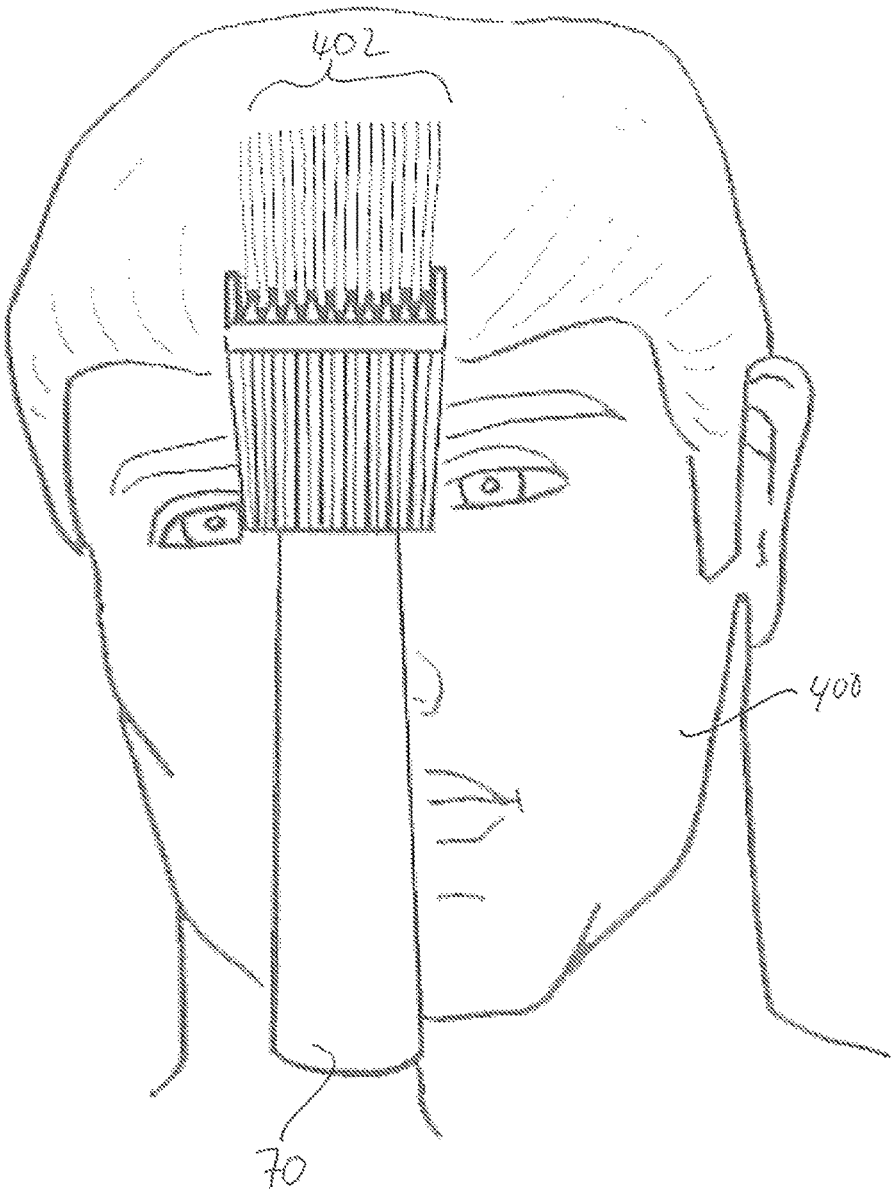
FIG. 35 is substantially showing the removal of the extension applicator from the hairline leaving the extensions in place with the hairline.

In one embodiment, suitable bonding or fusing extension adhesive 12 could be applied by a small brush to the extension tips 412 held captive within their extension grooves 76 (not shown). In another embodiment, as substantially shown in FIG. 17, the application of the suitable extension adhesive 12 to the extension tips 412 could be accomplished using a combination of adhesive applicator 240 moving within an adhesive tray 222. One possible version of the adhesive tray 222 could comprise of a tray base 222 having a generally rectangular open-topped cutout 224. The cutout 224 may be further defined by two tray sides 226, a removable tray end 228 and an assembly tray end 230 of the tray base 222. The removable tray end 222 could be removably held in place upon the tray base 222 between by open-topped, vertical side end channels 232 located in each of two tray sides 226. Once the removable tray end 228 is substantially removed (e.g., lifted up and out from the vertical side end channels 232), the extension adhesive 12 could be applied to one side of the removable tray end 228 (e.g., by a brush) in a suitable manner (e.g., not applying the suitable extension adhesive 12 to those portions of the side where the removable tray end 228 is retained by the two vertical side end channels 232.) Once the extension adhesive 12 is so applied, the removable tray end 228 can be reattached to the tray base 222 so the adhesive-applied side may located within the cutout 224. The assembly tray end 230 could be configured to support the extension applicator 70 by allowing the extension assembly 72 to be removably connected to the adhesive tray end 230 and within the cutout 224 (as substantially shown in FIG. 30.) Further, to generally guide the movement of the adhesive applicator 240 within the adhesive tray 220, each tray side 226 could have lengthwise applicator slit 234 proximate to the assembly tray end 230. The applicator slits 234 in opening upon the cutout 224 could movably accept a ridge 248 on the lengthwise edges of the adhesive applicator's base plate 242.

Figure 18:
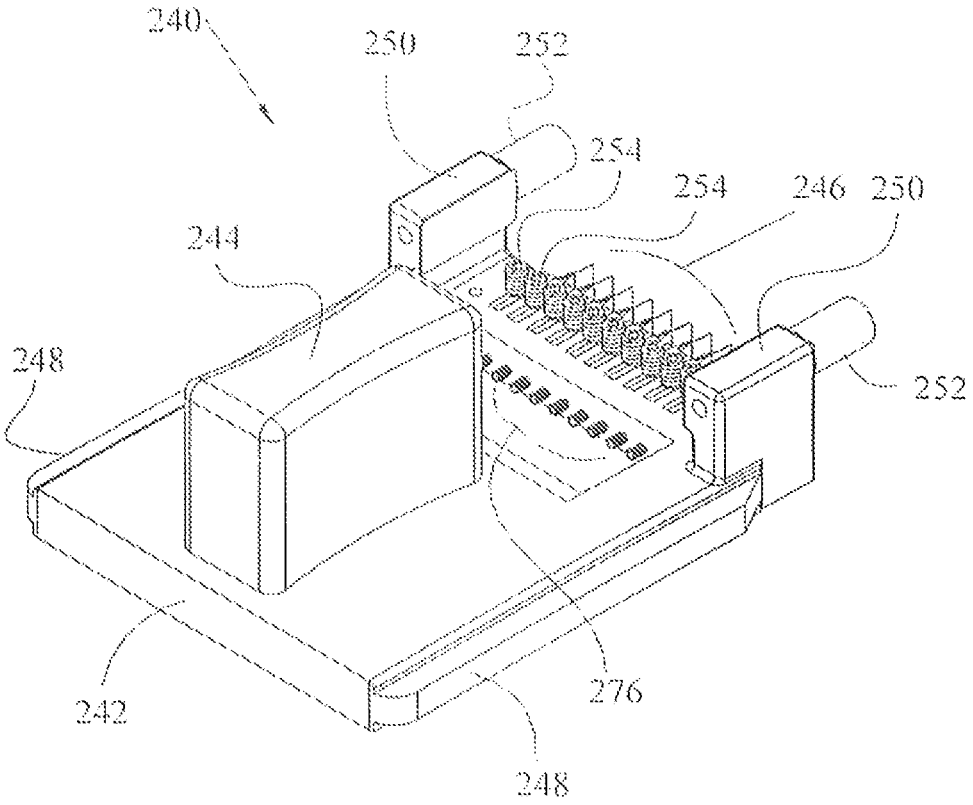
FIG. 18 is substantially a perspective view of one embodiment of the adhesive applicator.
Figure 19:
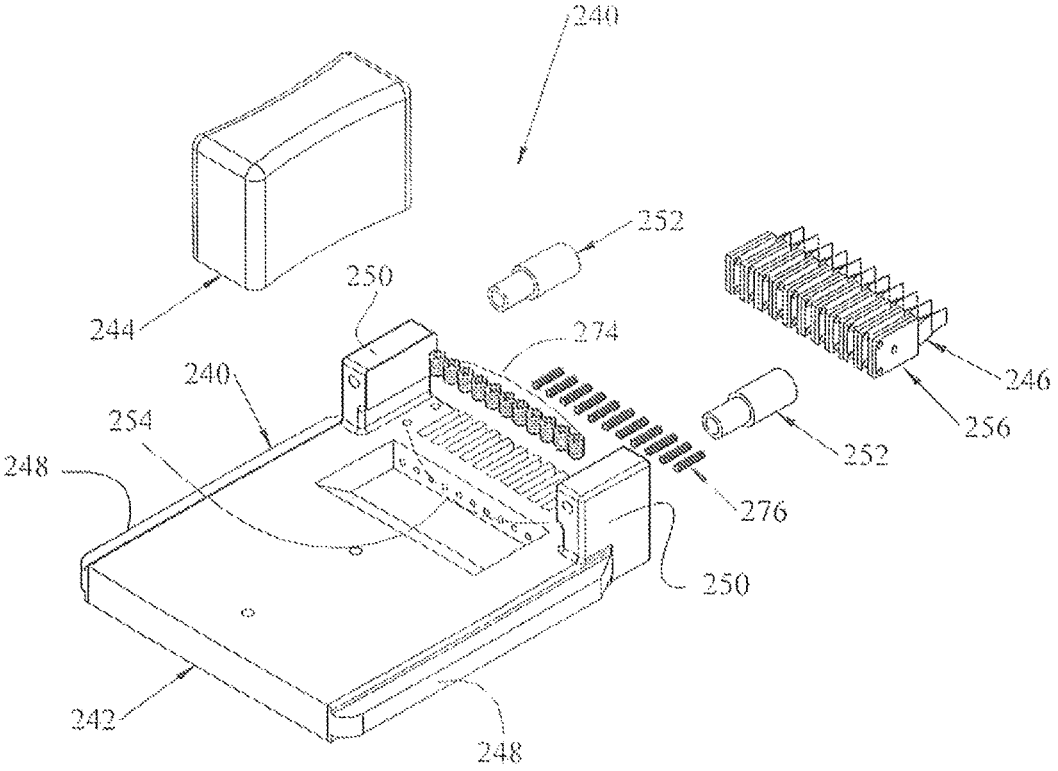
FIG. 19 is substantially a perspective exploded view of one embodiment of the adhesive applicator of the present invention.
Figure 20:
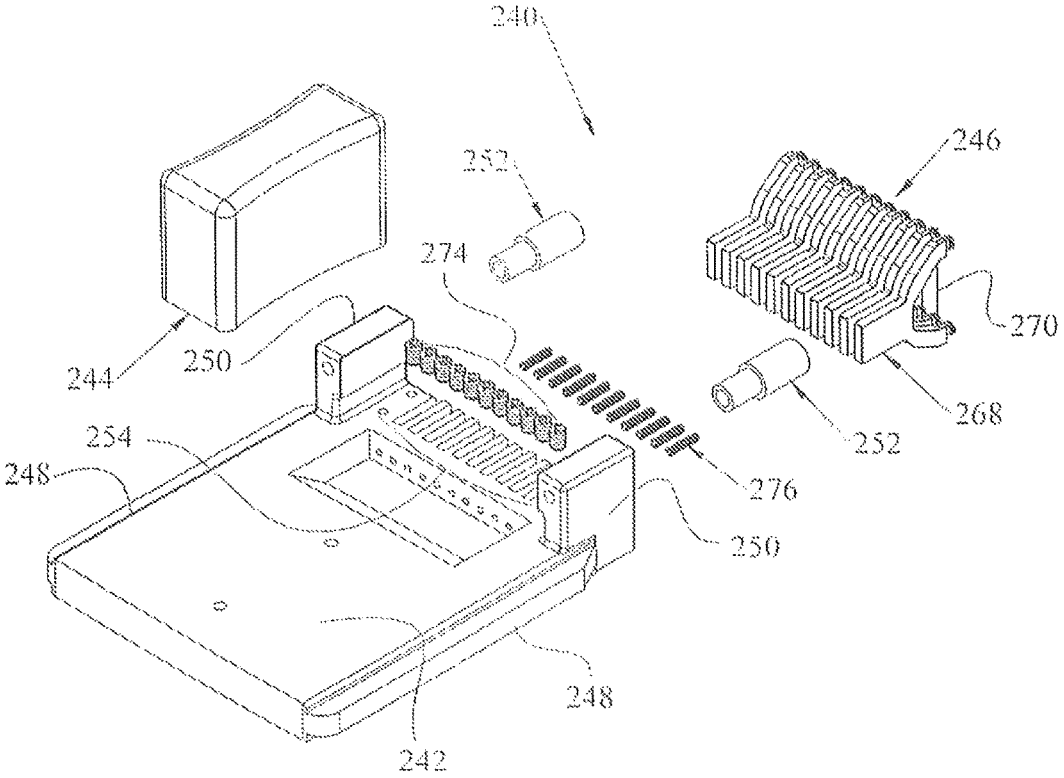
FIG. 20 is substantially a perspective exploded view of another embodiment of the adhesive applicator.
Figure 21:
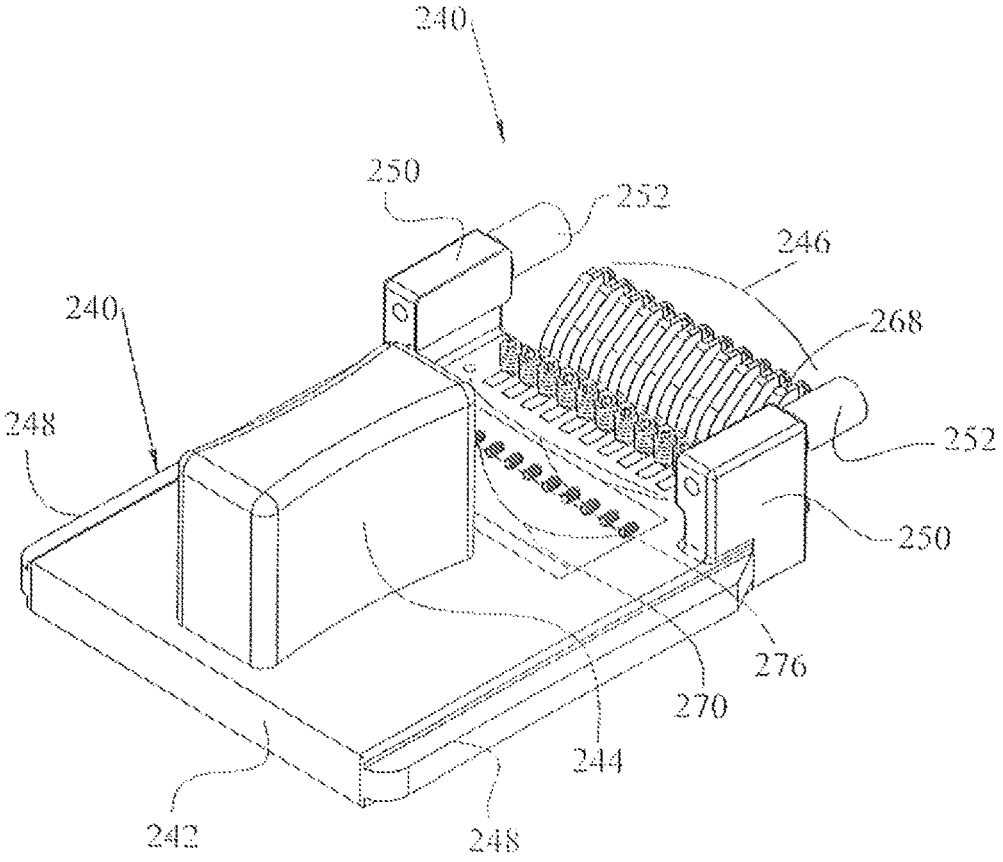
FIG. 21 is substantially a perspective view of another embodiment of the adhesive applicator of the present invention.

As substantially shown in FIGS. 18, 19, and 20 the adhesive applicator 240 could comprise a rectangular base plate 242 whose top 243 substantially supports a handle grip 244 while one end of the base plate 242 may further support a set of adhesive loaders 246. The base plate's lengthwise side edges could support ridges 248 that may removably engage adhesive tray's applicator slits 234 to generally allow the adhesive applicator 240 to substantially slide within the cutout 224 and removably lock into and mate with the extension applicator 70 as generally held by the extension assembly 72 to the adhesive tray 220. In this manner, adhesive loaders 246 carrying extension adhesive 12 can align with the respective extension grooves 72 to bring the extension adhesive 12 into general contact with the extension tips 412 as generally held within the extension grooves 72 (as substantially shown in FIG. 30.)

The set of adhesive loaders 246 could be sandwiched by a set of projections 250 extending up from the base plate 242. Each projection 250 could further mount a respective alignment tube 252 that can removably receive lockup insert 102 of the extension applicator 70. Further along the edge of the base plate 242 that could support the set of adhesive loaders could also be a set of spaced-apart notches 254. Each notch 254 could accept a portion of respective adhesive loader 246 in a manner that securely attaches the adhesive loader 246 onto the base plate 242. The handle grip 244 could be a rectangular-shaped block attached to the center of the top 243, the handle grip 244 further featuring slightly concave grip sides to generally allow the operator (not shown) to grasping the handle grip 244 without the tray sides 226 blocking the operator's fingers (not shown).

Figure 22:
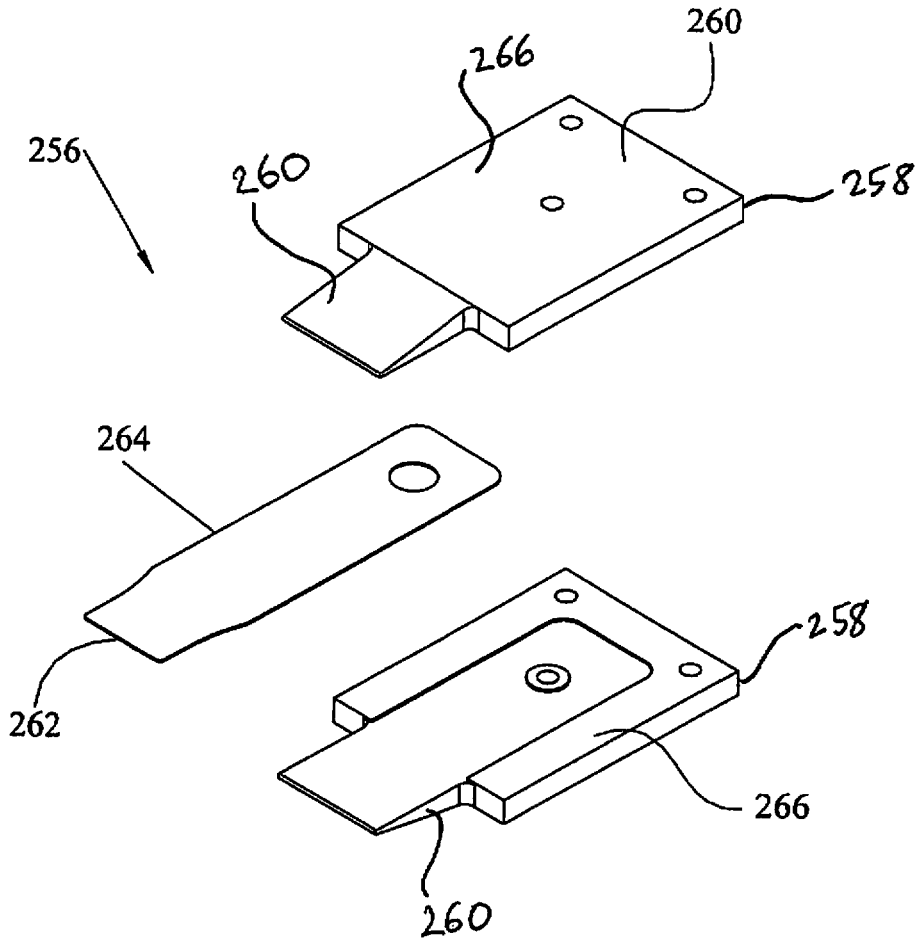
FIG. 22 is substantially a perspective exploded view of one embodiment of the adhesive loader of the present invention.

As substantially shown in FIG. 22, one embodiment of the adhesive loader 246 could comprise vertically oriented, spaced-apart tabs 256 with notch tab end 258 being received by a notch, while the taper edge tab end 260 has a tapered edge 262 (e.g., tapered to a thickness of a hair extension tip) to which the extension adhesive 12 is applied, the tapered edge tab end 260 being projected outward and away from base plate 242. One such version could have the adhesive loader 246 being a laminate with the tapered edge tab end 260 being a rectangular tab blade 264 sandwiched between two tab covers 266 that could form the other notch tab end 266.

Figure 23:
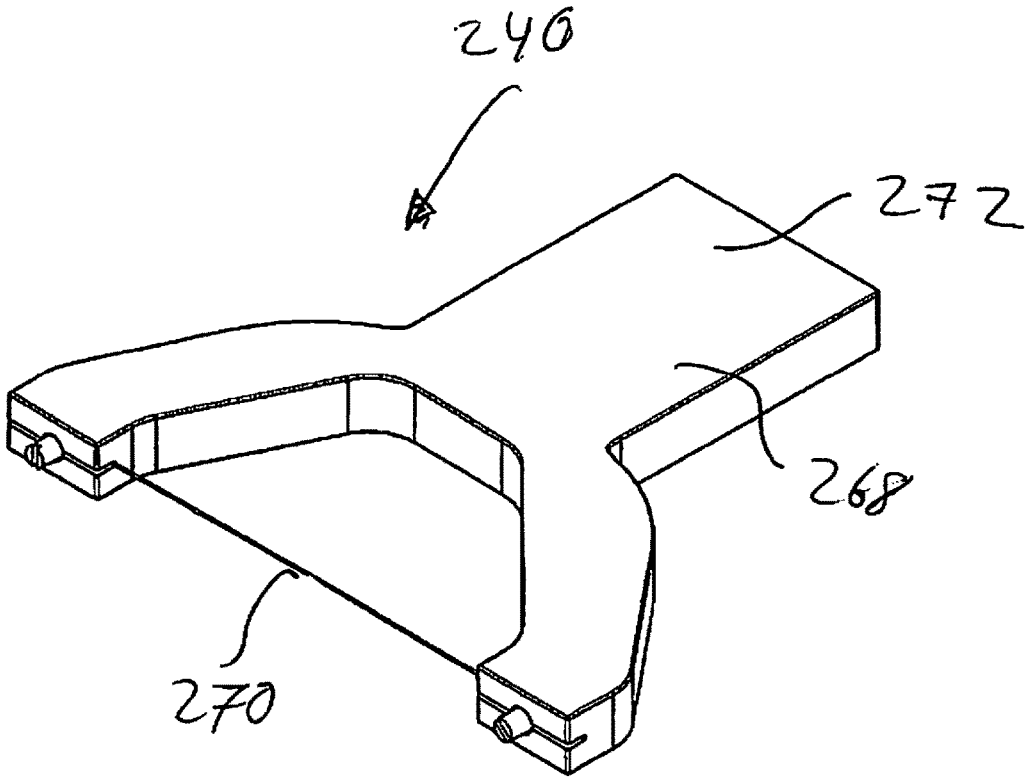
FIG. 23 is substantially a perspective view of another embodiment of the adhesive loader of the present invention.
Figure 24:
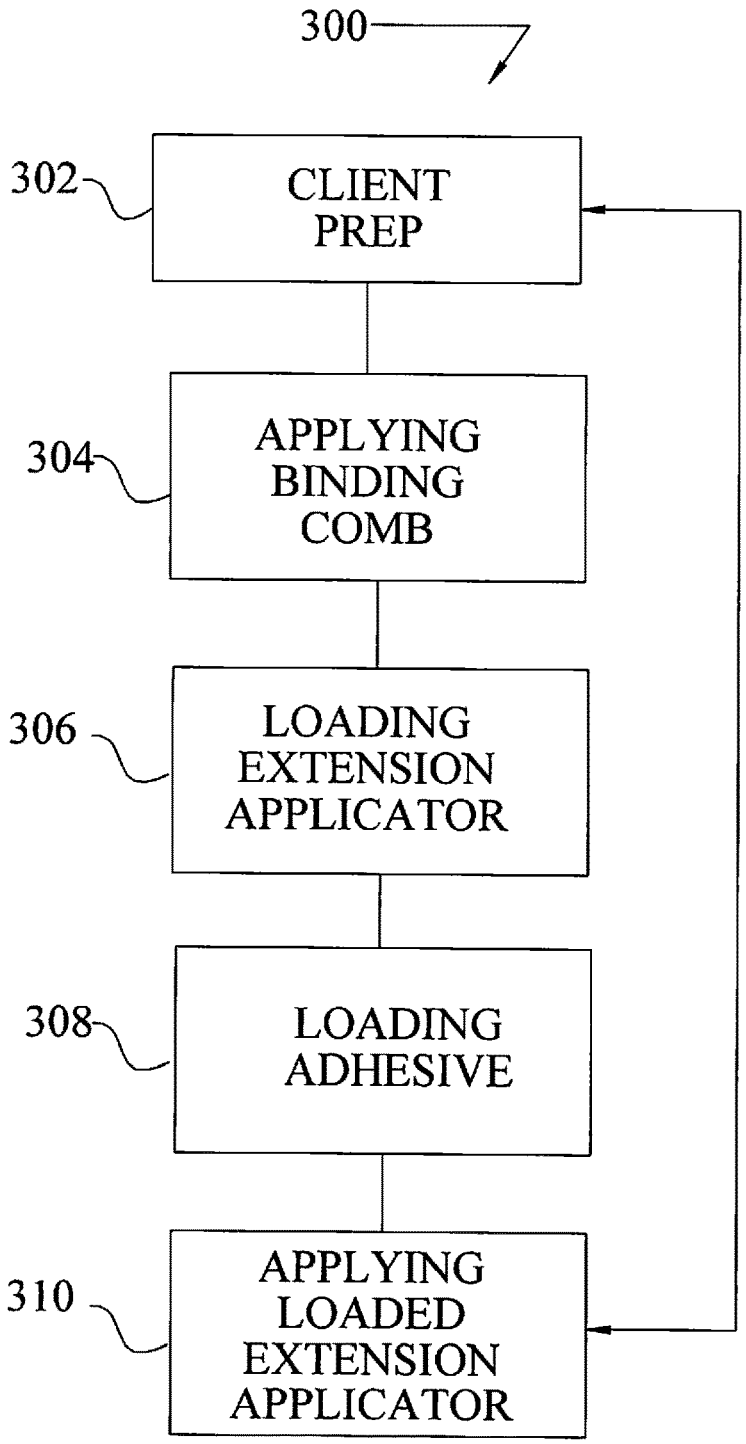
FIG. 24 is substantially a flowchart schematic showing one possible embodiment of a process or method for operating the present invention.
Figure 25:
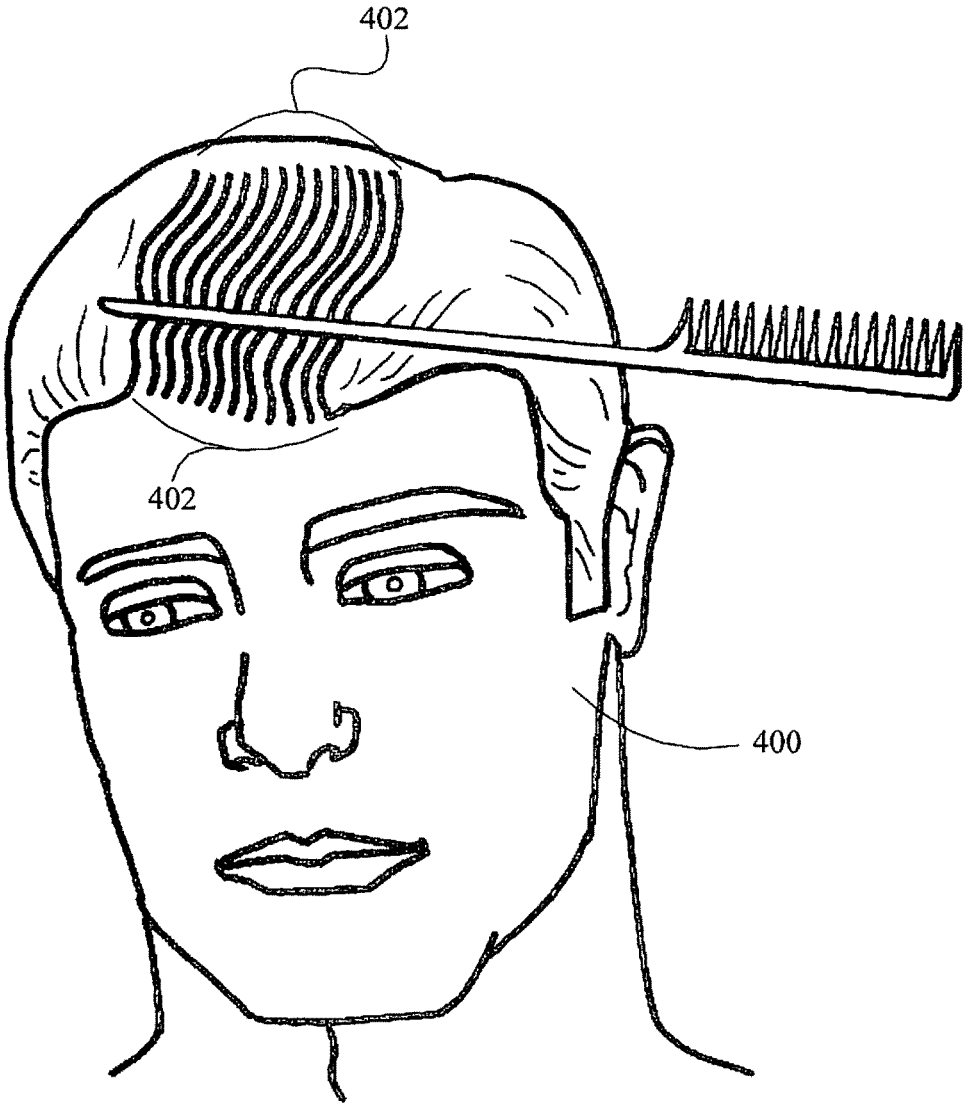
FIG. 25 is substantially showing the use of a styling comb to delineate a section of subject hair with hairlines.
Figure 26:
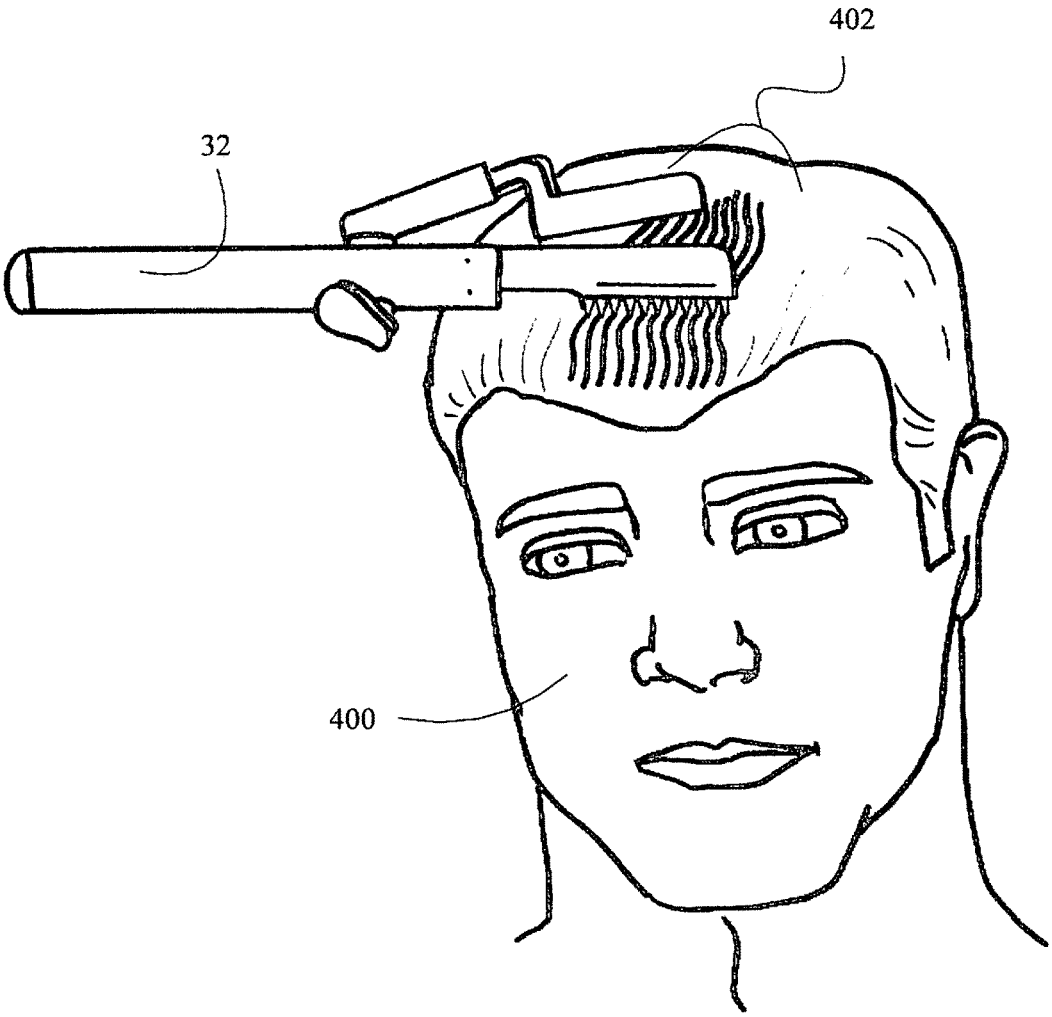
FIG. 26 is substantially showing the application of an open binding comb to a hairline.
Figure 27:
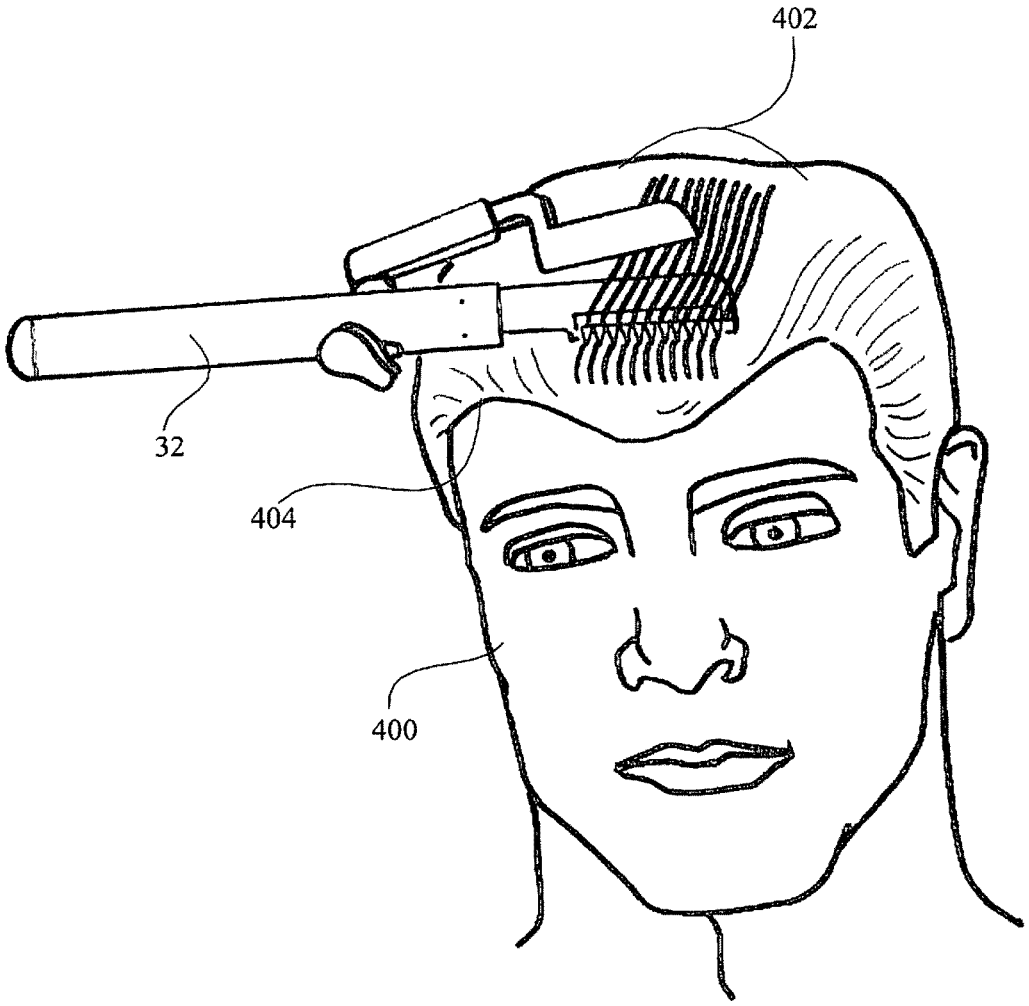
FIG. 27 is substantially showing the moving of a portion of hairline between the open comb clamp and prong section.
Figure 28:
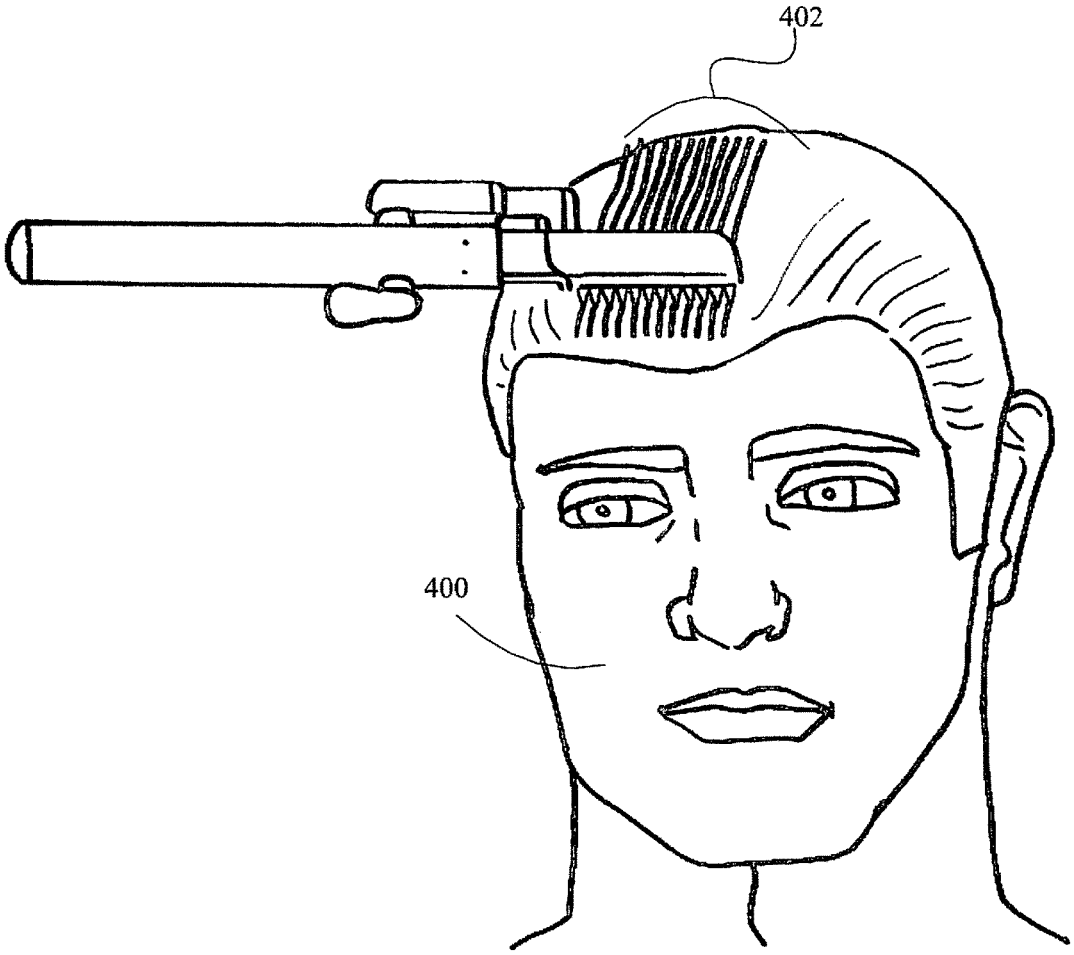
FIG. 28 is substantially showing the closing of comb clamp upon the prong section to secure a portion of the hairline to the binding comb.
Figure 29:
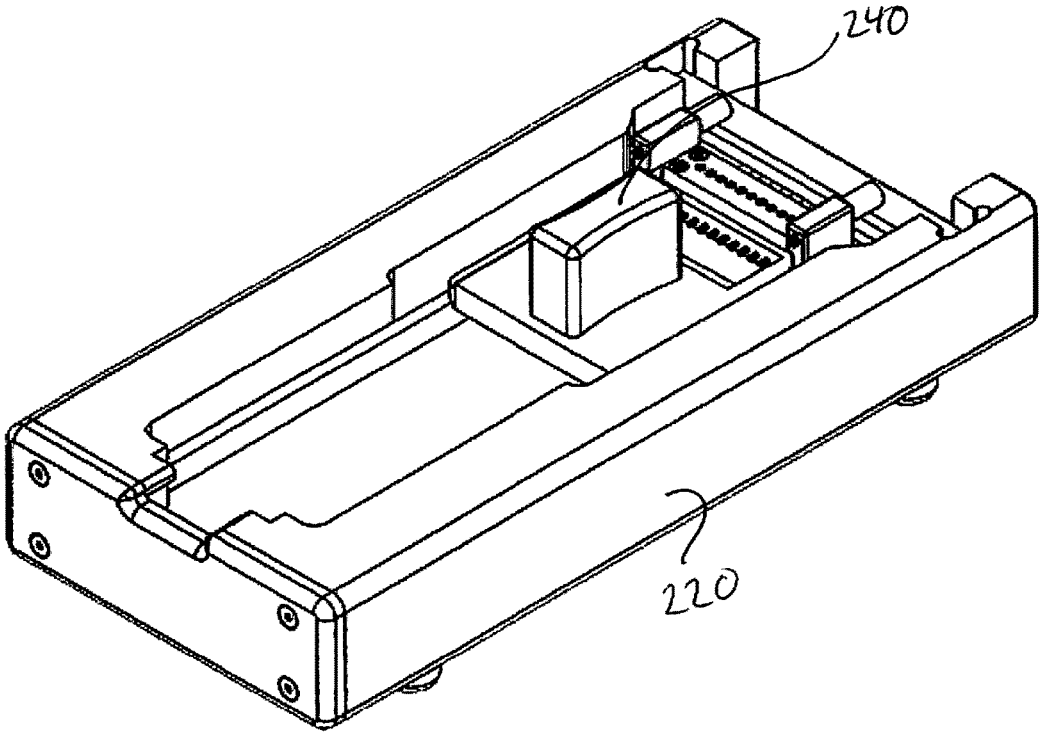
FIG. 29 is substantially showing the application of the extension adhesive to the adhesive applicator.

As substantially shown in FIG. 23, another embodiment of the adhesive loader 246 could comprise U-shaped frames 268 holding a wire 270 between the open ends of the frame-arms, the thickness of the wire 270 generally matching the thickness of the hair extension tip 412. The frame base 272 of the U-shaped frame 268 could be received at least partially into a respective notch 254 to substantially attach the U-shaped frame 268 to the base plate 242.

The frame bases 272, notch tab ends 258 and alike of the various types of adhesive loaders 246 could be attached to the notches 254 by adhesive means (e.g., silicon adhesive). In another version, suitable fasteners generally connecting to the base plate 242 and further impinging upon the frame bases 272, notch tab ends 258 and alike may hold the adhesive loaders 246 onto the base plate 242. To provide some flexing motion for the adhesive loaders 246 as the adhesive loaders impact with extension tips 412 to transfer extension adhesive 12 to the extension tips 412, the fastener-mounted adhesive loaders 246 could have loader coil springs 276 within the notches 254 to bias the adhesive loaders 246 forward.

As substantially shown in FIGS. 24-35, one possible embodiment for a method or process 300 of operating the invention 10 could start with step 302, preparation of the client. In this step, the operator could review with the client the type of hair extension treatment that is desired and the expected effect of the selected of hair extension treatment type upon the client's hair. The operator can then load sets of tube banks with the appropriate hair extensions as needed to complete the selected hair augmentation treatment program.

In one version, hair extensions to generally be loaded in the tube bank(s) could be previously prepared using a single core extension, the one end of which could denote an extension tip. Starting proximate to the extension tip, additional individual extensions could be attached using a suitable extension adhesive generally known in the art to the core hair extension in a manner that the additional individual extensions branch off of the core hair extension. The additional individual extensions could be added to the core hair extension so that a portion of the core hair extension denoting an extension tip lacks additional extensions, giving the completed extension a somewhat tree-like structure. The extension tip could be loaded into the tube of the tube bank through the open top end of the tube so that upon further insertion of the completed extension, the extension tip generally protrudes from the open bottom end of the tube.

A regular styling comb can then be used to part and pin back the hair into a delineated section of hair that is to receive hair extension, a section comprising of several hairlines. Once a section is augmented, another section could be delineated using the styling comb. This section and follow-up augmenting could be repeated until the desired amount of hair had been suitably augmented. Once this step is substantially completed, the process 300 can proceed to step 304, applying the binding comb.

In step 304, applying the binding comb, the operator can position the selected binding comb at the scalp by the selected hairline of the delineated section. The straight hair-type binding comb can be moved along the scalp so that individual hair strands of the hairline can be placed into between the binding comb prongs so that space between each prong contains a single hair strand.

The binding comb can then be lifted up and away from the scalp for a suitable distance (e.g., substantially sufficient to allow the extension assembly to removably connect with the binding comb and generally clear the scalp.) At that point the handle-operated clamp could be pivoted upward by rotating its handle. This could allow the clamp paddle/clamp blade to be lifted up and away from the prong section so that free portions of the comb-engaged individual hair strands can then lay against prong section behind the prongs. The handle-operated clamp can then be lowered down, the clamp being directed against the prong section by the comb spring. The handle-operated clamp could hold portions of the comb-engaged individual hair strands to prong section to generally secure the individual hair strands between the prongs to the binding comb.

If the curly hair or bifurcated version of the binding comb is employed, the operator may select the bifurcated binding comb and activate the fasteners holding the bifurcated comb handle together so that the bottom prong section can be spaced apart from the top prong section for the desired distance need to allow the extension assembly to removably connect to the binding comb. The bottom prong section can then be brought to rest upon the scalp. In another version of the binding comb, the bottom prong section can be brought first to rest upon the scalp and then the fasteners can be activated to substantially space apart the top prong section from the bottom prong section. In either version for the bifurcated binding comb, the bottom prong section can then be brought into contact with the selected hairline of the delineated section so that various single individual hair strands may be singularly located between respective prong pairings of the bottom prong section (i.e., generally, only one individual hair strand will be located between a interstitial space formed by a prong pair.) Similarly, the individual hair strands can then be singularly located in their respective spaces between various comb pairings of the top prong section (i.e., only one individual hair strand generally being located between a prong pair) so that the individual hair strand for a prong pairing of the bottom prong section will be located in between the congruous prong pairing for the top bottom prong section that is directly above said prong pairing of the bottom prong section.

At that time, the handle-operated clamp (e.g., clamp paddle/clamp blade) could be raised using the comb handle (pivoting the clamp away and off of the top prong section) allowing the individual hair strands generally held captive between the prongs to lie against the top of the non-prong portion of the top prong section. The handle-operated clamp could then be lowered by its comb handle to hold portions of the individual hair strands in between the clamp and the top prong section, the comb handle being directed against the top prong section by the comb spring. The handle-operated clamp could come to rest upon portions of the individual hair strands to substantially secure the individual hair strands between clamp blade and the top prong section.

As this step is substantially completed, the process 300 could proceed to step 306 loading hair extensions into the extension applicator.

In step 306, loading hair extensions into the extension applicator could start with a selected extension-loaded tube bank being placed into and removably secured to tube cups located at the top of the extension assemble. A top lever could be selected for extension tip loading and the selected top lever could then be lifted up and pivoted by a suitable tool such as tweezers or the like to an open position wherein the top lever's silicon tube does not contact the extension body. The extension tip from a corresponding tube could be brought down into plate channel of the lever plate pair being straddled by that top lever. The extension tip is then brought under the lever and into the space formed between the silicon tube and extension body (e.g. proximate to the top groove tip.) Enough of the extension tip is brought out from under the top lever to allow the extension tip to reach and be engaged by the corresponding bottom lever. At this time, the top lever may be released so the top lever's silicone tube can generally engage a portion of the extension tip and substantially hold that portion in place against the extension body.

At this time, the corresponding bottom lever can be raised, again by a suitable tool (not shown), into an operative position. The extension tip may be inserted through the space formed by the silicone tube and extension body (e.g., proximate to bottom groove tip) to move into the plate channel formed by the lever late pair that is straddled by the bottom lever. When a portion of the extension tip then clears the plate channel, the bottom lever can then be released to allow its silicone tube to impinge upon the extension tip and against the bottom groove tip to hold the extension tip into in place underneath the bottom lever. The extension tip could be further pulled so extension tip may rests tautly in place within its respective extension groove. This procedure can be repeated for the other tip extensions of the tube bank so that each extension groove may have a own extension tip properly secured within a respective extension groove Once this step is substantially completed, the process 300 could proceed to step 308, loading the adhesive applicator and adhesive tray.

In step 308, loading the adhesive applicator and adhesive tray, the revocable tray end can be removed from the tray base. One side of the removable tray end can have suitable extension fusing/bonding adhesive applied to that side, carefully avoiding those portions of the side that may come into direct contact with the rest of the tray base. The removable tray end may be then replaced back into the tray base so that the adhesive side is substantially within the cutout.

The adhesive applicator may then be placed into the cutout so that the set of adhesive loaders face the adhesive-loaded side of the removable tray end. The adhesive applicator may then moved within the cutout to bring the end tips or wires of the adhesive loaders into general contact with the extension adhesive of the adhesive-loaded side allowing the end tips or wires to be suitably coated with extension adhesive. The adhesive applicator may then back out of contact from the removable tray end. The adhesive applicator could then be lifted out of the adhesive tray; rotated 180° degrees (e.g., turned around) and could be reinserted into the cutout so that the set of adhesive loaders now generally faces the extension tray end.

The extension applicator may then be connected to the adhesive tray so that the adhesive tray generally holds the extension applicator upright with the extension assembly within the cutout and backing upon the extension tray end. The extension assembly may be so attached as to substantially present the groove side opening out upon the cutout. A furrow in the extension tray end may allow the handle to generally project out and away from the tray base.

The adhesive applicator could then be moved by the grip generally towards the extension assembly so that the adhesive applicator's ridges may removably engage the adhesive tray's slits to substantially direct the alignment tubes to the lockup inserts allowing for a relatively secure mating of the adhesive applicator to the extension assembly. In this manner, the adhesive-applied adhesive loaders may be directed into respective extension grooves where they can contact the respective extension tips (e.g., one adhesive loader per extension groove and hence extension tip) to generally transfer extension adhesive to the respective extension tips. The adhesive applicator could then be moved within the cutout to bring the adhesive applicator out of contact with the extension assembly (e.g., to the point wherein the adhesive applicator's ridges no longer engage the adhesive tray's slits and the lockup inserts are substantially free from the alignment tubes.) The adhesive-loaded extension applicator can then be removed from the adhesive tray.

As this step is substantially completed, the process 300 could move onto step 310, applying extension applicator to the binding comb.

In step 310, applying extension applicator to the binding comb, the adhesive-loaded extension applicator can be brought proximate to the binding comb. The locking inserts can be initially lined up with respective lockup channels of the binding comb. As the locking inserts removably move into the lockup channels, the extension grooves may respectively align up with interstitial spaces of the prong pairs to substantially move the adhesive-applied extension tips into a one-to-one match with the individual hair strands. The binding comb/extension applicator lockup could provide a hair strand-to-extension tip connection to provide an initial binding by extension adhesive of hair strand to respective extension tip.

Once the positive lockup of the extension applicator with the binding comb has occurred, the trigger assembly can be activated. The operator's depressing of the trigger, substantially moves the trigger link forward to moves the trigger foot's arm downwards. The trigger foot's downward movement generally rocks the trigger foot into the pin plate. This action moves the pin plate towards the extension assembly and the set of operative pins further through their respective extension assembly's pin channels. Top and bottom sets of operative pins as they move further through their respective pin channels respectively move the top and bottom levers into the open position thereby releasing the extension tips (as initially glued to the individual hair strands) from the extension applicator. The middle set of operative pins generally moves into respective extension grooves to substantially eject the glued extension tip/individual hair strand combination from the extension grooves.

The extension applicator may then be unlocked from the binding comb as the trigger is generally held to keep the top and bottom levers open. As the extension applicator generally moves away from the scalp, the individual hair strands may act as anchors for their glued extension tips to substantially bring the extension tips free from the bottom and top levers. As the hair extension tips clear the top levers, they may bring the remaining portion of the hair extension out of the tube; through the plate channel; underneath the top lever and between the silicone tube and the top groove tip. As the extension applicator generally moves further away from the binding comb and scalp, the rest of the hair extension may be brought out free from the extension applicator.

At this point, the comb paddle (through the paddle handle) can be raised to release the extension-hair strand combinations from the binding comb. The binding comb can then be brought away from the hair and scalp. It should be noted that the binding comb could be first released from the scalp, with the extension applicator being pulled away from the scalp subsequently. The process then can return to step 204 to be applied to another hairline. Once a hair section, hair sections or larger hair area have been augmented as desired, then the various fixing or fusion actions needed to complete the binding of extension to hair strand can be undertaken (e.g., applying sonic vibration, UV light, etc. to the extension-hair strand combinations.)

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A hair augmentation system comprising:

(A) a binding comb comprising a handle supporting a first prong section having a plurality of prongs and a clamp, the clamp is capable of removably securing one or more hair strands of a scalp placed within interstitial spaces between the plurality of prongs to the binding comb;

(B) an adhesive tray having a cutout;

(C) an adhesive applicator that moves within the cutout to transfer extension adhesive from the adhesive tray to one or more hair extensions;

(D) an extension applicator comprising:

i) an extension body having a set of extension grooves and a set of pin channels, where each extension groove has first and second levers, the first lever movably attaches proximate to a top of the extension groove and the second lever movably attaches to a bottom of the extension groove, and a set of operative pins are received within the set of pin channels; and ii) a trigger assembly acts upon the set of operative pins to cause the levers to release the one or more hair extensions from the extension applicator;

wherein the extension applicator removably mates to the binding comb so that during use, the one or more of hair extensions with extension adhesive held by the extension applicator simultaneously binds with the one or more hair stands held by the binding comb, and activation of the trigger assembly releases the bounded hair extension and hair strands from the extension applicator.

2. The hair augmentation system of claim 1 further comprising a tube bank connected to the extension applicator, the tube bank comprising a plurality of double open-ended tubes attached to each other side-by-side, each tube being adapted to removably contain at least one hair extension of the one or more hair extensions.

3. The hair augmentation of claim 1 wherein the adhesive applicator further comprises a plate connected to a grip, the plate having an edge supporting a set of vertically-oriented spaced apart adhesive loaders that transfer extension adhesive from the adhesive tray to one or more hair extensions as held within the set of extension grooves.

4. The hair augmentation of claim 3 wherein the set of vertically-oriented adhesive loaders is either a set of vertical wires or a set of tabs that support the extension adhesive.

5. The hair augmentation of claim 1 wherein the adhesive applicator is oriented in one direction to receive the extension adhesive and oriented in an opposite direction to deliver the extension adhesive to the extension applicator.

6. The hair augmentation of claim 5 wherein the adhesive applicator is removed from the adhesive tray and then replaced in the adhesive tray to change the orientation of the adhesive applicator within the adhesive tray.

7. The hair augmentation of claim 6 wherein the adhesive applicator, when in contact with the adhesive tray, is slideable along a length of the adhesive tray.

8. The hair augmentation of claim 6 wherein the adhesive tray has opposing first and second end, the first end supports a supply of extension adhesive and the second end to removably support and align the extension applicator to receive extension adhesive.

9. The hair augmentation of claim 1 wherein the adhesive applicator has at least two alignment tubes that removably connect with at least two lockup inserts supported by the extension applicator to align individual sections of extension adhesive with respective hair extensions of the one or more hair extensions held by the extension applicator.

10. The hair augmentation of claim 1 wherein the adhesive applicator has at least two alignment tubes that removably connect with at least two lockup inserts supported by the extension applicator to align individual sections of extension adhesive with the respective extension grooves.

11. The hair augmentation of claim 1 wherein the binding comb further comprises a second prong section that is opened to be spaced apart from and parallel to the first prong section, wherein during use, the one or more hair strands contact both the first and second prong sections.

12. The hair augmentation of claim 1 wherein the set of operative pins, when acted upon by the trigger assembly, acts upon the hair extensions with extension adhesive to push the bound one or more hair extensions and hair strands out of the extension grooves.

13. A process for the operation of a hair augmentation system comprising the following steps, but not necessarily in the order shown:

(A) providing a binding comb having a handle supporting a first prong section with a plurality of spaced apart prongs and a comb clamp moveable between an open, unclamped position and a closed, clamped position;

(B) loading each of interstitial comb spaces defined by the prong section with only a single individual hair strand from a hairline of a customer, then lowering the comb clamp into the closed position upon the said hair strands to removably clamp the hair strands to the binding comb;

(C) providing an extension applicator with a set of side-by-side extension grooves, each extension groove including a pair of levers that removably holds a respective hair extension within the extension groove; upon activation of a trigger assembly, the levers release the hair extensions from the respective extension grooves;

(D) providing an adhesive applicator that moves within a cutout of an adhesive tray, one tray end of the adhesive supporting an extension adhesive within the cutout while another tray end removably supports a portion of the extension applicator within the cutout;

(E) moving the adhesive applicator relative to the adhesive tray to transfer the extension adhesive from the one tray end to the hair extensions held by the extension applicator as the extension applicator is supported by the other tray end;

(F) removably attaching the extension applicator to the binding comb so that the hair extensions having the extension adhesive thereon as held by the extension applicator simultaneously binds with the hair stands individually held apart by the binding comb;

(G) activating the trigger assembly as the extension applicator is separated from the binding comb; and (H) moving the clamp into the open position releasing the hair stands as the binding comb is moved away from the hairline of a customer.

14. The process of claim 13 wherein the step of removably attaching the extension applicator with the binding comb further comprises aligning each of the extensions grooves with a corresponding one of the interstitial comb spaces creating paired extension grooves and interstitial comb spaces, such that only the hair extension and the individual hair strand of the paired extension grooves and interstitial spaces bind together.

15. The process of claim 13 wherein the step of activating the trigger assembly further comprising a step of moving a plurality of operative pins to eject the bound hair extensions and hair strands from the extension grooves.

16. The process of claim 13 wherein the step of activating the trigger assembly further comprising a step of releasing the bound hair extensions and hair strands from the respective extension grooves.

17. The process of claim 13 further comprising a step of aligning the adhesive applicator to the extension applicator so that adhesive loaders of the adhesive applicator move into the extension grooves to simultaneously apply the extension adhesive provided on the adhesive loaders to the hair extensions disposed within the extension grooves.

18. The process of claim 13 wherein the step of moving the adhesive applicator relative to the adhesive tray further comprises a step of removably combining at least two alignment tubes of the adhesive applicator with at least two lockup inserts supported by the extension applicator to align an individual section of the extension adhesive with the respective extension grooves.

19. The process of claim 13 wherein the step of loading each of interstitial comb spaces further comprises a step of spacing apart a second prong section from the first prong section to have one or more hair strands contacting both the spaced apart first and second prong sections.

* * * * *